US012173976B1

(12) United States Patent
Clutter

(10) Patent No.: US 12,173,976 B1
(45) Date of Patent: Dec. 24, 2024

(54) FIREARMS SUPPRESSOR

(71) Applicant: James Keith Clutter, Houston, TX (US)

(72) Inventor: James Keith Clutter, Houston, TX (US)

( * ) Notice: Subject to any disclaimer, the term of this patent is extended or adjusted under 35 U.S.C. 154(b) by 0 days.

(21) Appl. No.: 18/217,430

(22) Filed: Jun. 30, 2023

Related U.S. Application Data

(60) Provisional application No. 63/438,912, filed on Jan. 13, 2023, provisional application No. 63/393,650, filed on Jul. 29, 2022, provisional application No. 63/389,736, filed on Jul. 15, 2022.

(51) Int. Cl.
*F41A 21/30* (2006.01)
*F41A 21/34* (2006.01)

(52) U.S. Cl.
CPC ..... *F41A 21/30* (2013.01); *F41A 21/34* (2013.01)

(58) Field of Classification Search
CPC ..... F41A 21/30; F41A 21/34
See application file for complete search history.

(56) References Cited

U.S. PATENT DOCUMENTS 2,514,996 A * 7/1950 Faust, Jr. ..... F41A 21/34 181/223
2,925,755 A * 2/1960 Krus ..... F41A 21/30 89/14.3
4,530,417 A 7/1985 Daniel
5,029,512 A 7/1991 Latka
5,355,765 A 10/1994 Rogers
5,996,501 A 12/1999 Spencer et al.
6,024,189 A * 2/2000 Heuser ..... F01P 5/10 181/281
6,575,074 B1 * 6/2003 Gaddini ..... F41A 21/30 89/14.4
7,905,319 B2 * 3/2011 Sullivan ..... F01N 1/086 181/232
8,087,338 B1 * 1/2012 Hines ..... F41A 21/36 89/14.3
8,516,941 B1 * 8/2013 Oliver ..... F41A 21/30 89/14.4
8,910,745 B2 12/2014 Latka
8,939,057 B1 * 1/2015 Edsall ..... F41A 21/30 89/14.05

(Continued)

FOREIGN PATENT DOCUMENTS

EP 2191223 11/2011
WO WO20040667 A 2/2020
WO WO2020040667 2/2020

OTHER PUBLICATIONS

Zhao et al., Numerical Simulation and Experiment on Impulse Noise in a Small Caliber Rifle with Muzzle Brake, Sep. 2019, https://www.researchgate.net/publication/335706248_Numerical_Simulation_and_Experiment_on_Impulse_Noise_in_a_Small_Caliber_Rifle_with_Muzzle_Brake.

(Continued)

*Primary Examiner* — Joshua E Freeman
(74) *Attorney, Agent, or Firm* — Carver, Darden, Koretzky, Tessier, Finn, Blossman & Areaux, LLC; Raymond G. Areaux; J. Matthew Miller, III

(57) ABSTRACT

Disclosed herein are improved firearms suppressor designs that use interior baffles and bypass channels to direct gas discharged from a firearm so as to reduce the cone shock produced by the expanding discharged gas and therefore also reduce the sound produced by that firearm.

21 Claims, 24 Drawing Sheets

(56) References Cited

U.S. PATENT DOCUMENTS

| | | | | |
|---|---|---|---|---|
| 9,052,152 | B2 | 6/2015 | Moss et al. | |
| 9,239,201 | B1 | 1/2016 | Reis Green | |
| 9,347,727 | B1 * | 5/2016 | Cler | F41A 21/30 |
| 9,500,427 | B1 | 11/2016 | Larue | |
| 10,598,458 | B1 * | 3/2020 | Cler | F41A 21/30 |
| 11,255,623 | B2 | 2/2022 | Kras et al. | |
| 11,378,348 | B2 | 7/2022 | Poling | |
| 2015/0001002 | A1 * | 1/2015 | Wirth | F41A 21/30 181/223 |
| 2018/0306544 | A1 * | 10/2018 | White | F41A 21/30 |
| 2019/0204038 | A1 * | 7/2019 | Conner | F41A 21/30 |
| 2020/0309478 | A1 * | 10/2020 | Meaux | F41A 21/30 |
| 2021/0018287 | A1 * | 1/2021 | Kada | F41A 21/30 |
| 2021/0172694 | A1 * | 6/2021 | Reel | F41A 21/32 |
| 2022/0099402 | A1 | 3/2022 | Lvov | |
| 2022/0163281 | A1 | 5/2022 | Madigan et al. | |

OTHER PUBLICATIONS

Hudson et al., The Evaluation of Computational Fluid Dynamics Methods for Design of Muzzle Blast Suppressors for Firearms, Propellants, Explosives, Pyrotechnics 26, 201-208 (2001).

Clutter et al., Computation of Compressible Internal Flow for Interior Ballistic Applications, AIAA/ASME/SAE/ASEE Joint Propulsion Conference Jun. 27-29, 1994.

Hudson et al., CFD Approach to Firearms Sound Suppressor Design, AIAA/ASME/SAE/ASEE Joint Propulsion Conference & Exhibit, Jul. 1-3, 1996.

Viswanathan et al., Characteristics of the Shock Noise Component of Jet Noise, AIAA Journal vol. 48, No. 1, Jan. 2010.

Clutter et al., Computation of High-Speed Reacting Flow for Gun Propulsion Applications, Numerical Heat Transfer, Part A, 31:355-374, 1997.

Clutter, J.K., Computation of High-Speed Reacting Flows, University of Florida, Gainesville, 1997, UMI 9801080.

Horst et al., Flame-Spreading Processes in a Small Caliber Gun, Army Research Laboratory, Aberdeen Proving Ground, Maryland, Jul. 2007.

Bin et al., A Numerical Study on the Generation of Impulsive Noise by Complex Flows Discharging from a Muzzle, International Journal for Numerical Methods in Engineering 2008; 75:964-991, Mar. 19, 2008.

Zhao et al., Numerical Simulation and Experiment on Impulse Noise in a Small Caliber Rifle with Muzzle Brake, Shock and Vibration, vol. 2019, Article ID 5938034; https://doi.org/10.1155/2019/5938034.

Ritter et al., Primer Output and Initial Projectile Motion for 5.56 and 7.62 mm Ammunition, US Army Research Laboratory ARL-TR-7479, Sep. 2015.

Suppressor Images, Mar. 5, 2019.

* cited by examiner

FIREARMS SUPPRESSOR

CROSS-REFERENCE TO RELATED APPLICATIONS

This application claims priority from U.S. Provisional Application Nos. 63/389,736 (Clutter) filed Jul. 15, 2022, 63/393,650 (Clutter) filed Jul. 29, 2022, and 63/438,912 (Clutter) filed Jan. 13, 2023, each of which is incorporated herein by reference as if set forth in full below.

BACKGROUND OF THE INVENTION

I. Field

The present invention relates to an improved firearms suppressor for reducing sound created when a gun is fired. More particularly, disclosed herein are new principles for designing firearms suppressors and novel designs utilizing the principles disclosed herein.

II. Background

SUMMARY OF THE INVENTION

An exemplary embodiment of the present invention provides a suppressor for reducing noise and muzzle flash generated by a firearm, comprising: one or more blade chambers, wherein each of said one or more blade chambers comprises: an entrance wall on a first side of each said blade chamber, an exit wall on a second side of each said blade chamber opposite said first side, and an outer wall connecting said entrance wall and said exit wall; further wherein said entrance wall comprises an entrance hole and said exit wall comprises an exit hole: an interior space defined by said entrance wall, said exit wall, and said outer wall for containing propellant gases from said firearm; a plurality of coaxial blades disposed within said interior space for redirecting said propellant gases, each of said plurality of coaxial blades comprising an approximate conical frustum with a center hole in a center of each said approximate conical frustum, and having a narrow end and a wide end, wherein said narrow end of each said approximate conical frustum faces said entrance hole and said wide end of each said approximate conical frustum faces said exit hole; and one or more support members; wherein each of said one or more blade chambers is configured to be removably attachable to one or more of said firearm, a muzzle brake, and another said blade chamber; wherein said entrance hole, said exit hole, and each of said center holes are coaxial along a central axis and are capable of allowing a projectile fired from said firearm to pass through said entrance hole, each of said center holes, and said exit hole along said central axis; wherein said plurality of coaxial blades are configured to form a gap between each said wide end of each of said plurality of coaxial blades and said narrow end of each one of said plurality of coaxial blades that is immediately adjacent to said each said wide end; wherein each of said plurality of coaxial blades is affixed to at least one of said one or more support members and each of said one or more support members is affixed to an interior side of said outer wall of said blade chamber; and wherein placement of each of said plurality of coaxial blades forms a bypass for allowing gas flow between each said wide end of each of said plurality of coaxial blades and said outer wall of said interior space.

An exemplary embodiment of the present invention also provides a suppressor wherein each of said plurality of coaxial blades have approximately the same dimensions.

An exemplary embodiment of the present invention also provides a suppressor wherein each of said one or more support members is coplanar with said central axis.

An exemplary embodiment of the present invention also provides a suppressor wherein each said bypass is between approximately 8 percent and approximately 63 percent of a cross-sectional area of said interior space that is perpendicular to said central axis.

An exemplary embodiment of the present invention also provides a suppressor wherein each said bypass is between approximately 13 percent and 50 percent.

An exemplary embodiment of the present invention also provides a suppressor wherein each said bypass is between approximately 28 percent and 35 percent.

An exemplary embodiment of the present invention also provides a suppressor, further comprising at least two blade chambers.

An exemplary embodiment of the present invention also provides a suppressor, further comprising at least three blade chambers.

An exemplary embodiment of the present invention also provides a suppressor further comprising at least one suppressor chamber that is not one of said one or more blade chambers.

An exemplary embodiment of the present invention also provides a suppressor wherein said approximate conical frustum is curved.

An exemplary embodiment of the present invention provides a suppressor for reducing noise and muzzle flash generated by a firearm, comprising: one or more blade chambers, wherein each of said one or more blade chambers comprises a means for reducing cone shock.

An exemplary embodiment of the present invention also provides a suppressor wherein said means for reducing cone shock comprises a plurality of blades and each of said blades has approximately the same dimensions.

An exemplary embodiment of the present invention also provides a suppressor wherein said means for reducing cone shock comprises one or more support members and each of said one or more support members is coplanar with a central axis of said suppressor.

An exemplary embodiment of the present invention also provides a suppressor wherein each of said one or more blade chambers comprises an outer wall and wherein a minimum distance between said blades and said outer wall defines a bypass and said bypass is between approximately 8 percent and approximately 63 percent of a cross-sectional area of an interior space of each respective one of said one or more blade chambers, wherein said cross-sectional area is perpendicular to a central axis of said suppressor.

An exemplary embodiment of the present invention also provides a suppressor wherein each said bypass is between approximately 13 percent and 50 percent.

An exemplary embodiment of the present invention also provides a suppressor wherein each said bypass is between approximately 28 percent and 35 percent.

An exemplary embodiment of the present invention also provides a suppressor further comprising at least two blade chambers.

An exemplary embodiment of the present invention also provides a suppressor further comprising at least three blade chambers.

An exemplary embodiment of the present invention also provides a suppressor further comprising at least one suppressor chamber that is not one of said one or more blade chambers.

BRIEF DESCRIPTION OF THE DRAWINGS

FIGS. 19A and 19B depict partial cross-sectional views of two different four-cavity suppressors.

Figure 1:
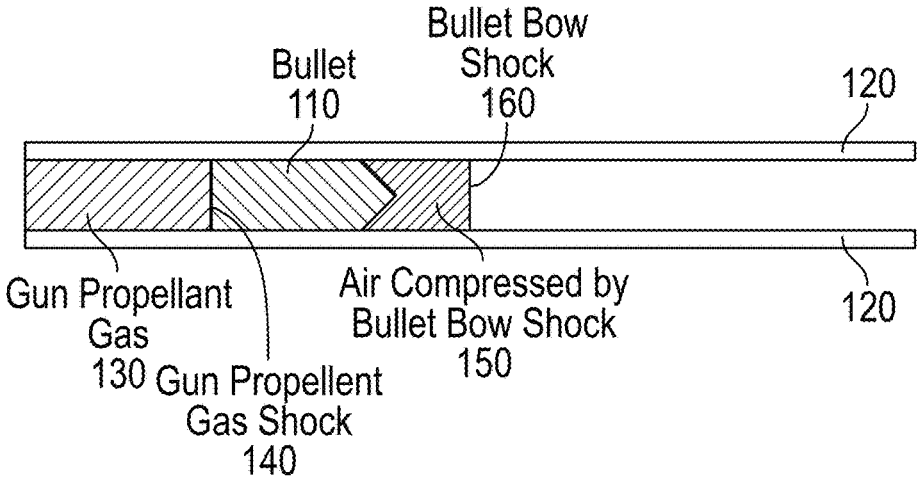
FIG. 1 depicts a side view of a bullet being fired from a gun prior to leaving the gun barrel.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention that may admit to other equally effective configurations. It is contemplated that features of one configuration may be beneficially incorporated in other configurations without further recitation.

DETAILED DESCRIPTION OF THE INVENTION

A firearms suppressor is a device designed to be affixed to the barrel of a gun for the purpose of reducing the sound and/or vibration caused by firing that gun. A variety of different designs for firearms suppressors exist, including, without limitation, designs discussed in U.S. Pat. No. 5,996,501 to Spencer et al. I believe that I have discovered acoustic-mechanical properties relating to flow and gas expansion resulting from firearm discharge.

Turning now to the figures, FIG. 1, shows a bullet 110 traveling through gun barrel 120 after being fired. Also shown are gun propellant gas 130, gun propellant gas shock 140, compressed air 150, and bullet bow shock 160. In a typical gun, gun propellant gas 130 expands, pushing bullet 110 down gun barrel 120 and also creating gun propellant gas shock 140.

Figure 2:
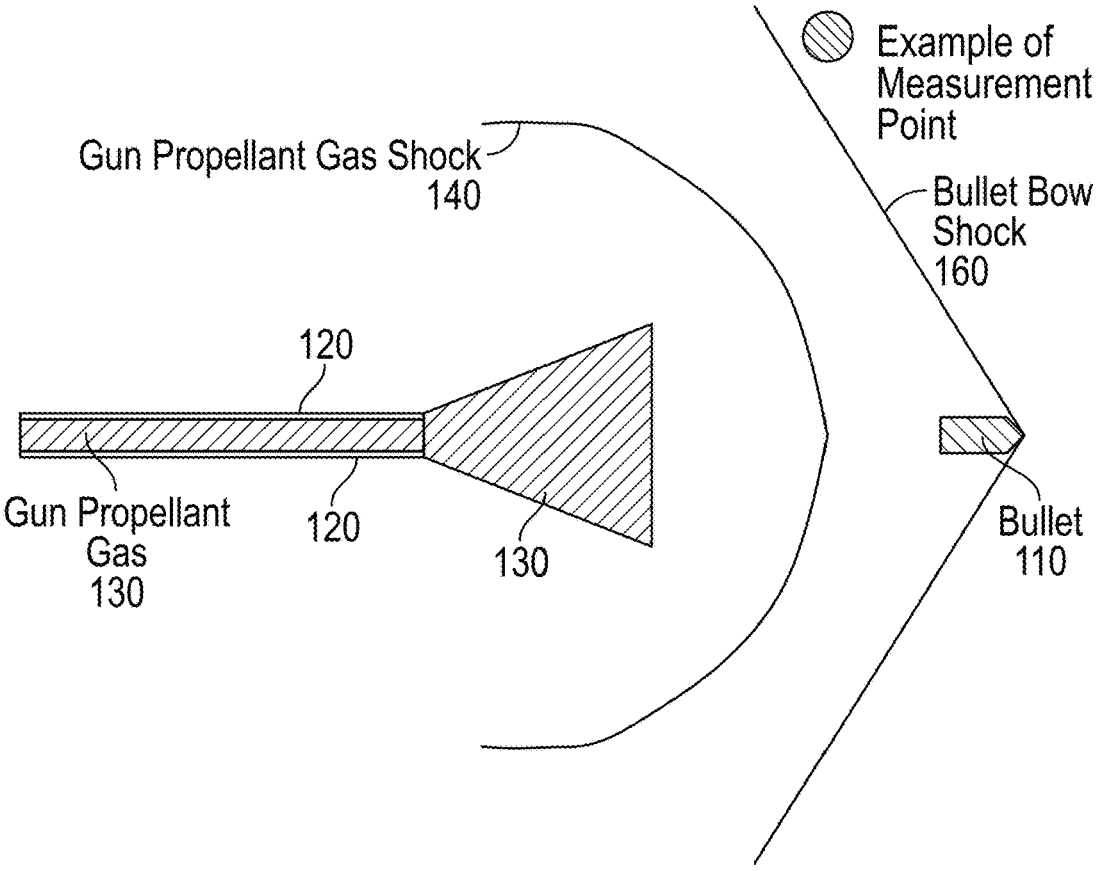
FIG. 2 depicts a side view of a bullet being fired from a gun after leaving the gun barrel.

FIG. 2 shows the same elements as FIG. 1 after bullet 110 has traveled out of gun barrel 120. Because bullet bow shock 160 is formed by bullet 110, bullet bow shock 160 has also moved out of gun barrel 120. FIG. 2 also shows the expansion of gun propellant gas 130 down and out of gun barrel 120, thereby creating gun propellant gas shock 140. Gun propellant gas shock 140 is behind bullet 110 and travels further away from gun barrel 120 than the volume of gun propellant gas 130.

Figure 3:
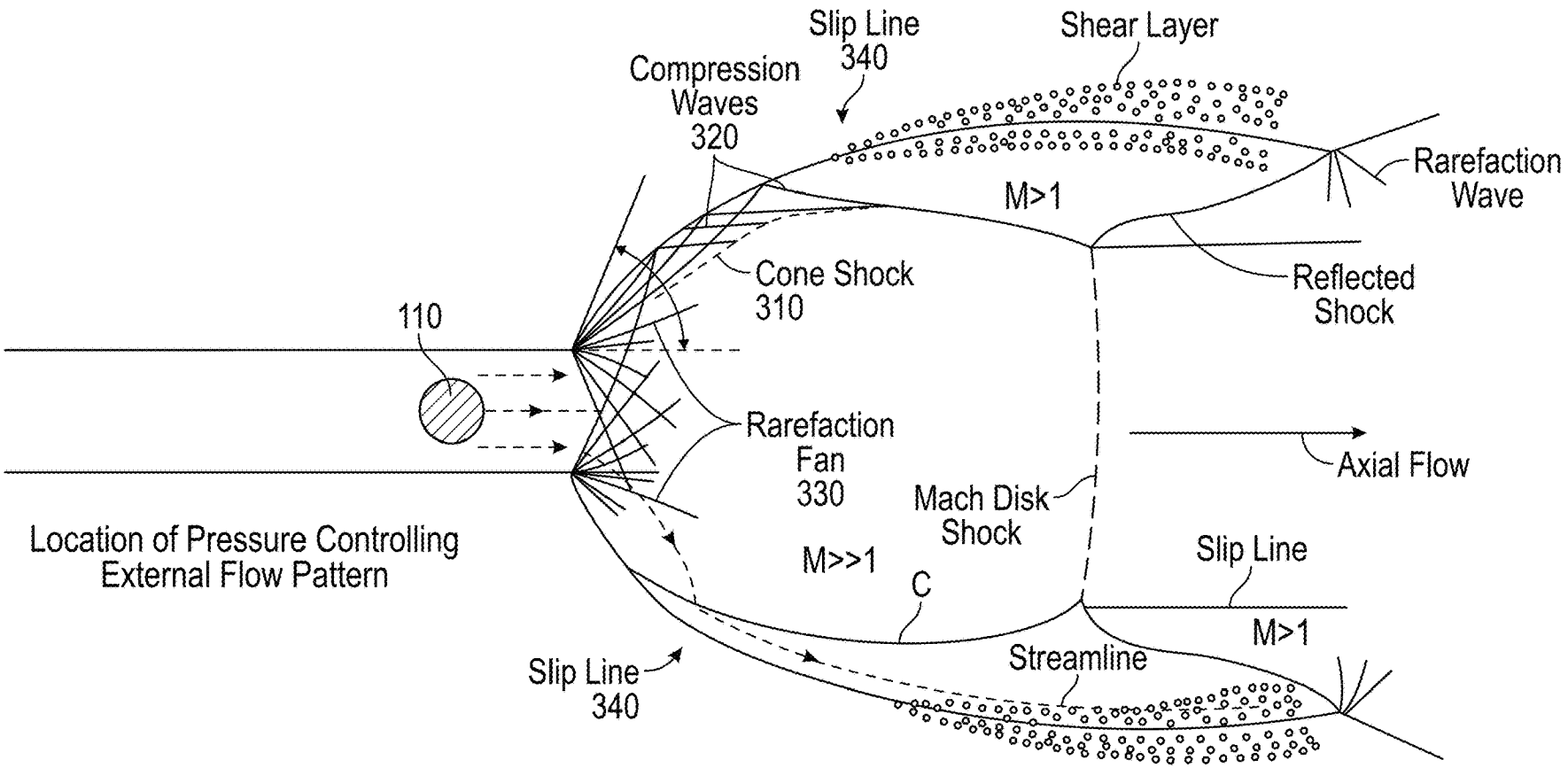
FIG. 3 depicts a side view of certain physical properties of gas pressure as a bullet travels forward.

FIG. 3 shows a schematic of pressure waves that result from a gun firing. The firing of a typical gun creates cone shock 310, and the exact position of cone shock 310 fluctuates, thereby creating compression waves 320. I have discovered that reverberations of pressure inside typical firearms suppressors create pressure changes that result in reverberations in cone shock 310 and that reducing these reverberations results in significantly improved suppressor performance.

I speculate that during the release of all the high pressure gun gas, when volumes of high pressure reach the exit of a suppressor (or the exit of a bare muzzle), rarefaction fan 330 has to expand wider to allow the high pressure to drop to ambient pressure, causing stronger compression waves 320. In other words, radial motion of the slip line 340 and associated compression waves 320 compress the ambient air and produce the undesired noise at third area 720 (see, e.g., FIG. 7A). I also speculate that reducing reverberations of pressure inside of a suppressor decreases this effect and results in improved performance, particularly at third area 720.

Figure 4:
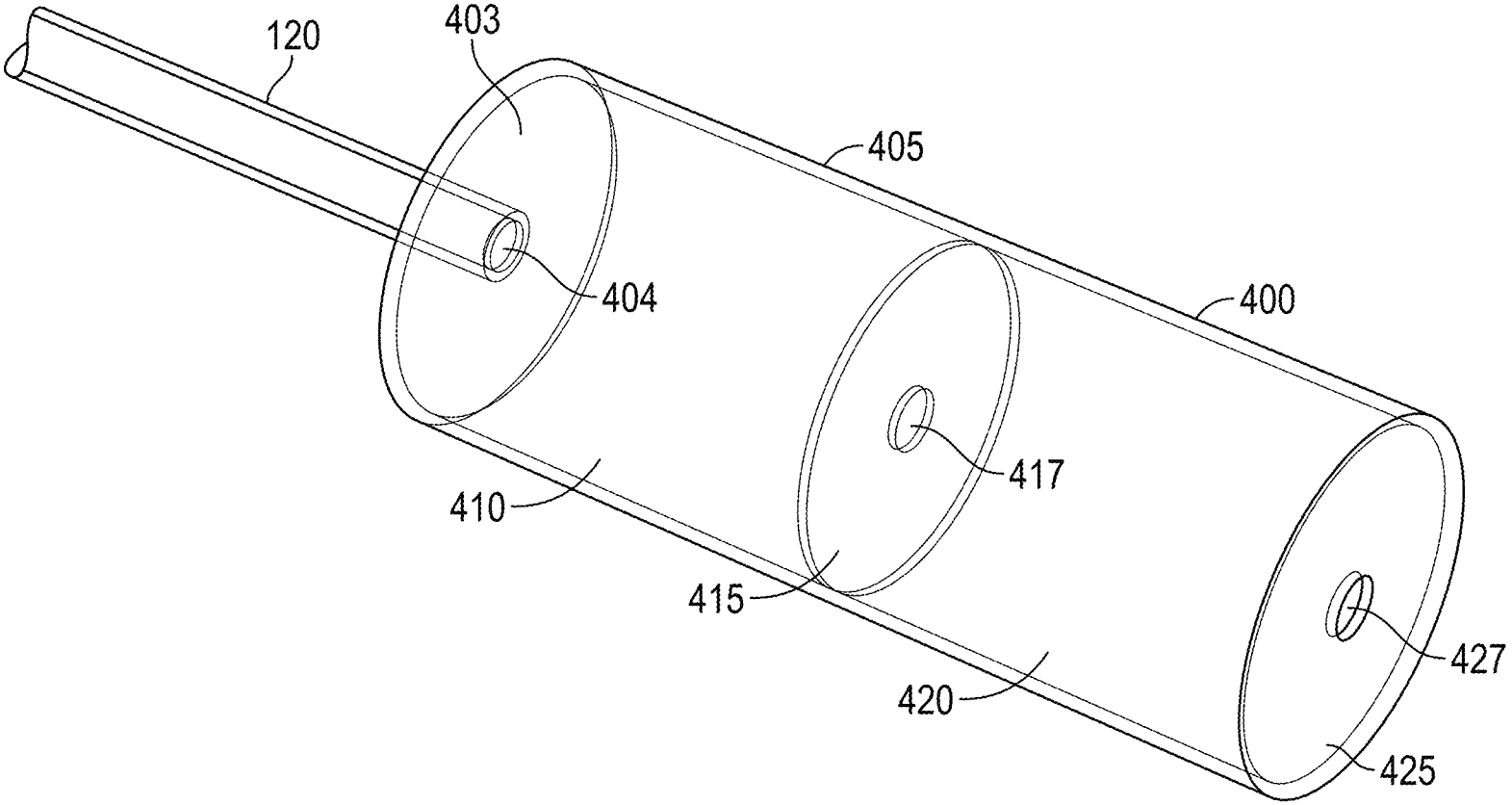
FIG. 4 depicts a perspective view of an example prior art suppressor.

FIG. 4 depicts basic suppressor 400 connected to a gun barrel 120. In this exemplary embodiment of a prior art suppressor, basic suppressor 400 comprises first end cap 403, outer wall 405, first chamber 410, divider 415, second chamber 420, and second end cap 425. First chamber 410 and second chamber 420 are separated by divider 415. First end cap 403 comprises connector hole 404, divider 415 comprises center hole 417, and second end cap 425 comprises exit hole 427. In some embodiments, connector hole 404 is a threaded hole that can be removably attached to gun barrel 120. In operation, when a bullet 110 travels down and exits gun barrel 120, the bullet 110 passes through connector hole 404 into first chamber 410, through center hole 417 into second chamber 420, and through exit hole 427. Some embodiments of basic suppressor 400 may include holes in outer wall 405. It is my understanding that creators of suppressors like basic suppressor 400, and other suppressors of the prior art, are attempting to limit the sound and shockwaves of bullet 110 by containing and slowly dissipating pressure. It is also my understanding that some suppressors of the prior art are touted as having heat dissipating properties. The basic suppressor 400 depicted in FIG. 4 is also known as a "flat baffle" suppressor, with divider 415 also being referred to as a "baffle."

Figure 5A:
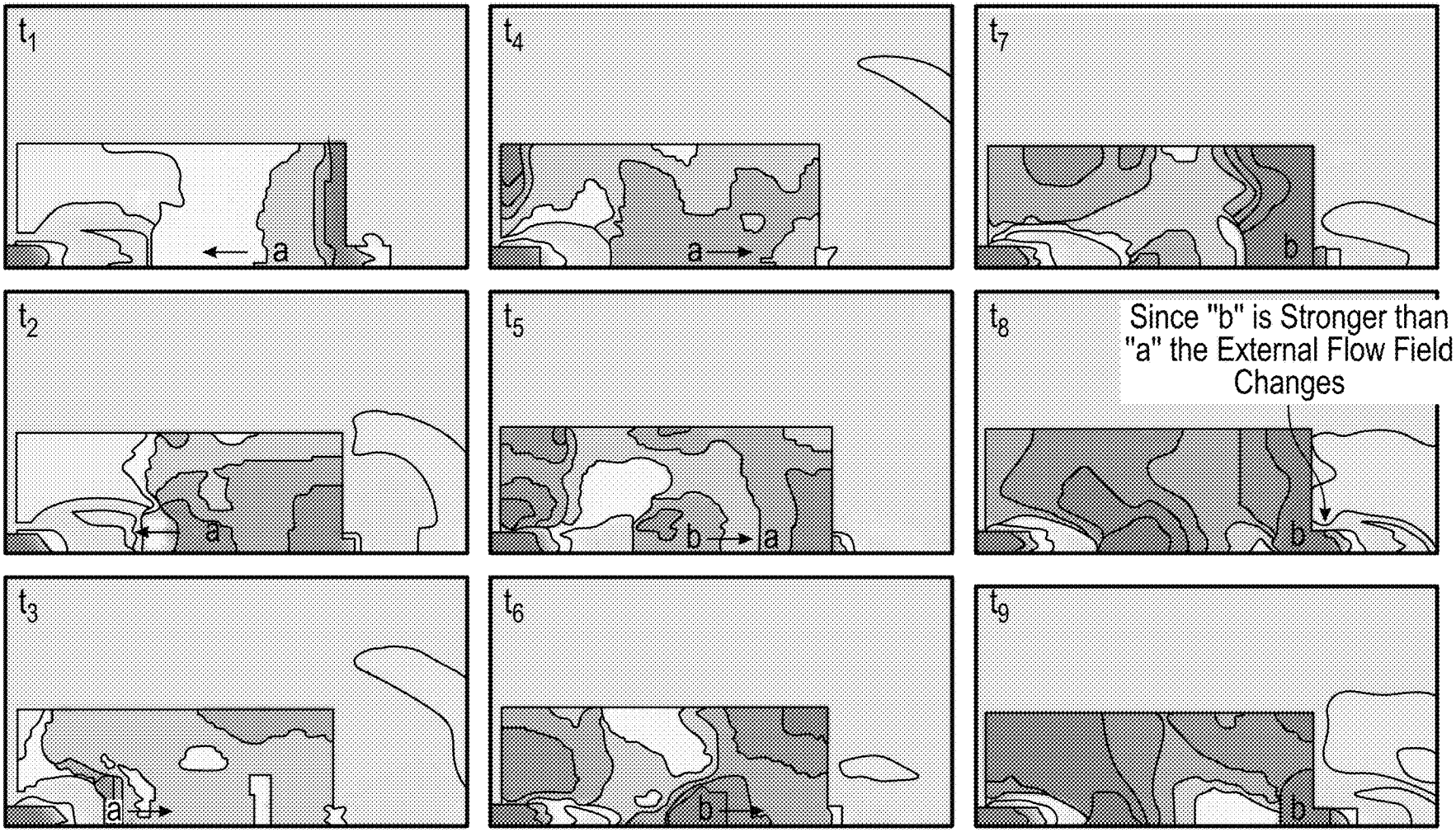
FIGS. 5A and 5B are different illustrations of the same time sequence of side views of a simulation of air pressure as a bullet is fired from a gun through an example prior art suppressor.
Figure 5B:
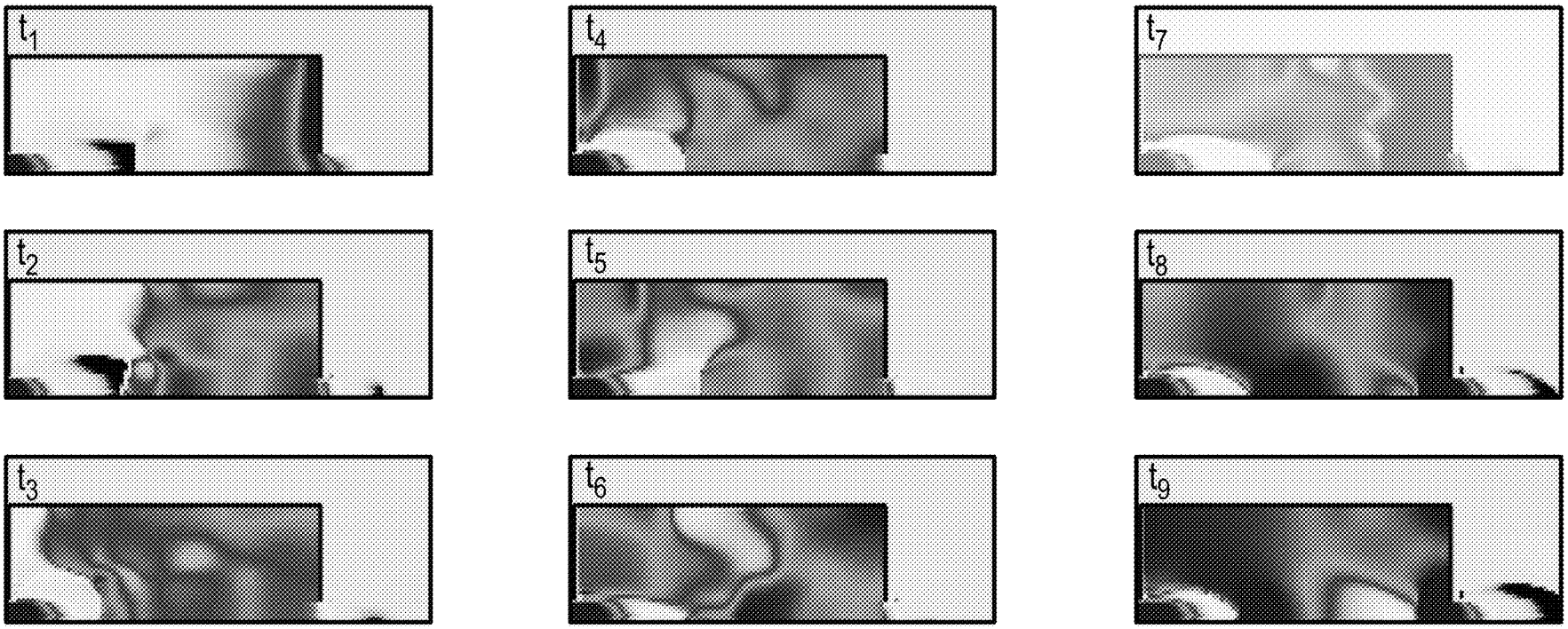

FIGS. 5A and 5B depict the same time sequence of a simulation of pressure inside a single-chamber "flat baffle" suppressor immediately after a bullet 110 has been fired and passed through the suppressor moving from the left to the right. The difference between FIGS. 5A and 5B is that FIG. 5A is a line drawing containing shaded segments, whereas FIG. 5B shows the output of a simulation upon which FIG. 5A is based. As depicted in FIGS. 5A and 5B, the suppressor is a rectangular cross-section of a right circular cylinder, the path of the bullet is along the line bounding the bottom of the image (from the bottom left towards the bottom right of each image), the darkness in each image is a function of pressure, where the contour is of log(P) where P=pressure. Higher pressure outside of the rectangular area (e.g., pointed to by the arrow in t8 of FIG. 5A) is the external flow field. The external flow field is the volume of pressurized gas leaving a gun barrel or suppressor and not contained by the gun barrel or suppressor and is shown in more detail in FIG. 3, Pressure ranges from 3981 Pa (where the contour is approximately 3.6) to 1,000,000 Pa (where the contour is 6). In other words, dark areas are higher pressure than lighter areas. The time sequence shows the following:

At t1, pressure (labeled "° a") has built up near the exit of the suppressor.

At t2, the pressure travels back towards the entrance of the suppressor.

At t3, the pressure reaches the entrance and bounces back towards the exit of the suppressor.

At t4, the pressure continues traveling towards the exit of the suppressor.

At t5, the continued expansion of gas causes another volume of higher pressure (labeled "b") to travel towards the exit of the suppressor.

At t6 through t9, the additional volume of higher pressure continues traveling towards the exit of the suppressor.

As depicted with reference to t9, when the additional volume of higher pressure is higher pressure than the first volume of high pressure, the external flow field changes.

I speculate that reverberation of higher pressure volumes inside a suppressor causes reverberation of cone shock 310 and that reverberation of cone shock 310 is a leading cause of sound produced by gunshots fired through traditional suppressors such as basic suppressor 400. In other words, suppressor designs that reduce reverberations of high pressure inside the suppressor also show improved suppressor performance.

Figure 6:
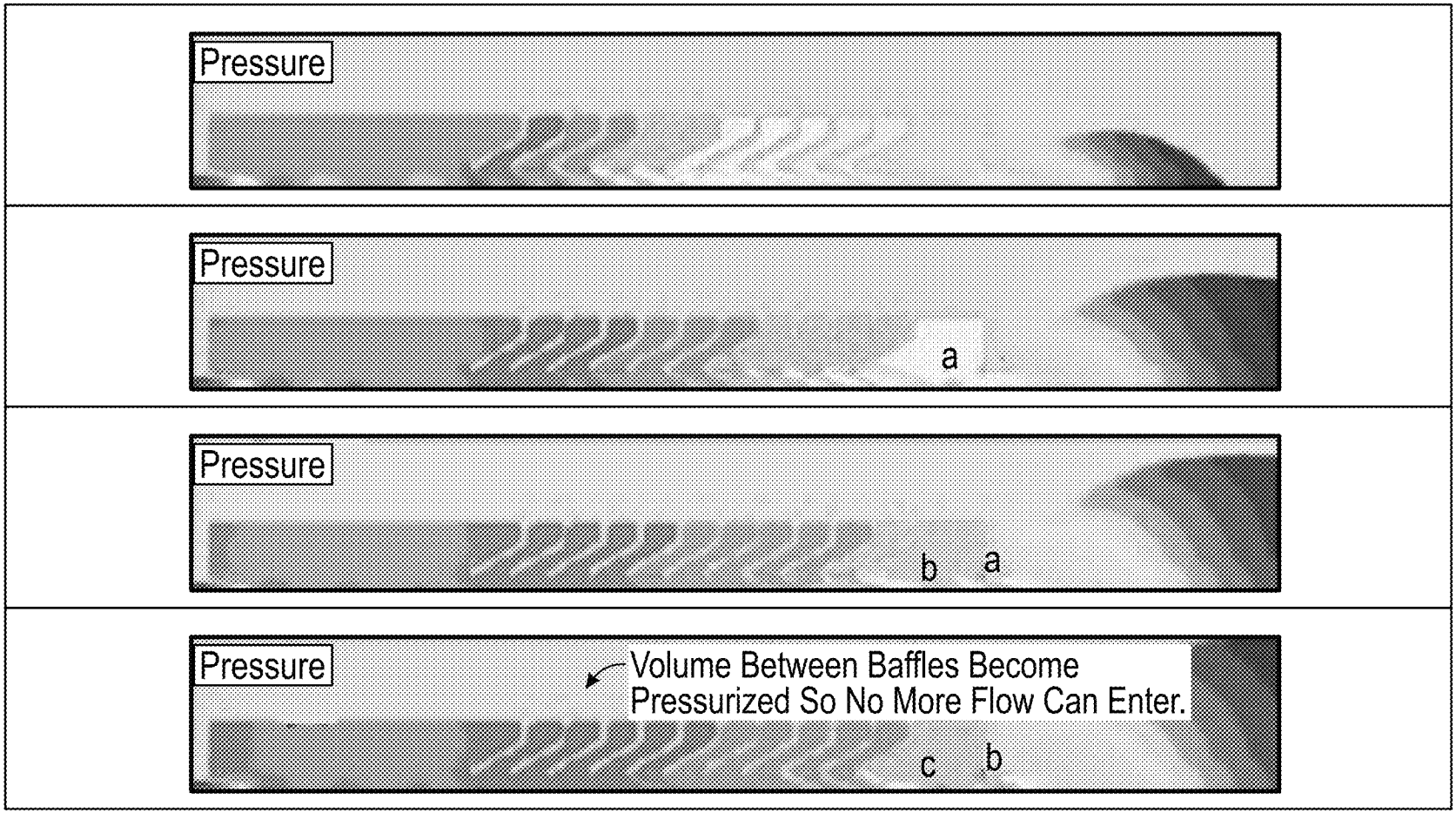
FIG. 6 is a time sequence of side views of a simulation of pressure as a bullet is fired from a gun through an example prior art suppressor.

FIG. 6 depicts a time sequence of a simulation of pressure inside a "conical baffle" suppressor immediately after a bullet 110 has been fired and passed through the suppressor moving from the left to the right. The suppressor depicted in the simulation shown in FIG. 6 is patterned after the Banish 30 Gold suppressor from Silencer Central. As depicted in FIG. 6, the darkness in each image is a function of pressure. As shown, the conical baffles of the suppressor simulated to produce FIG. 6 fill with higher pressure. However, individual chambers formed by the conical baffles are not connected. Once each individual chamber becomes filled with high pressure gas, I speculate that additional high pressure gas does not enter the chambers. Thus, I speculate that this design continues to suffer from the problem that high pressure reverberates inside the chamber, producing reverberations in the cone shock, causing less than optimal suppressor performance.

Figure 7A:
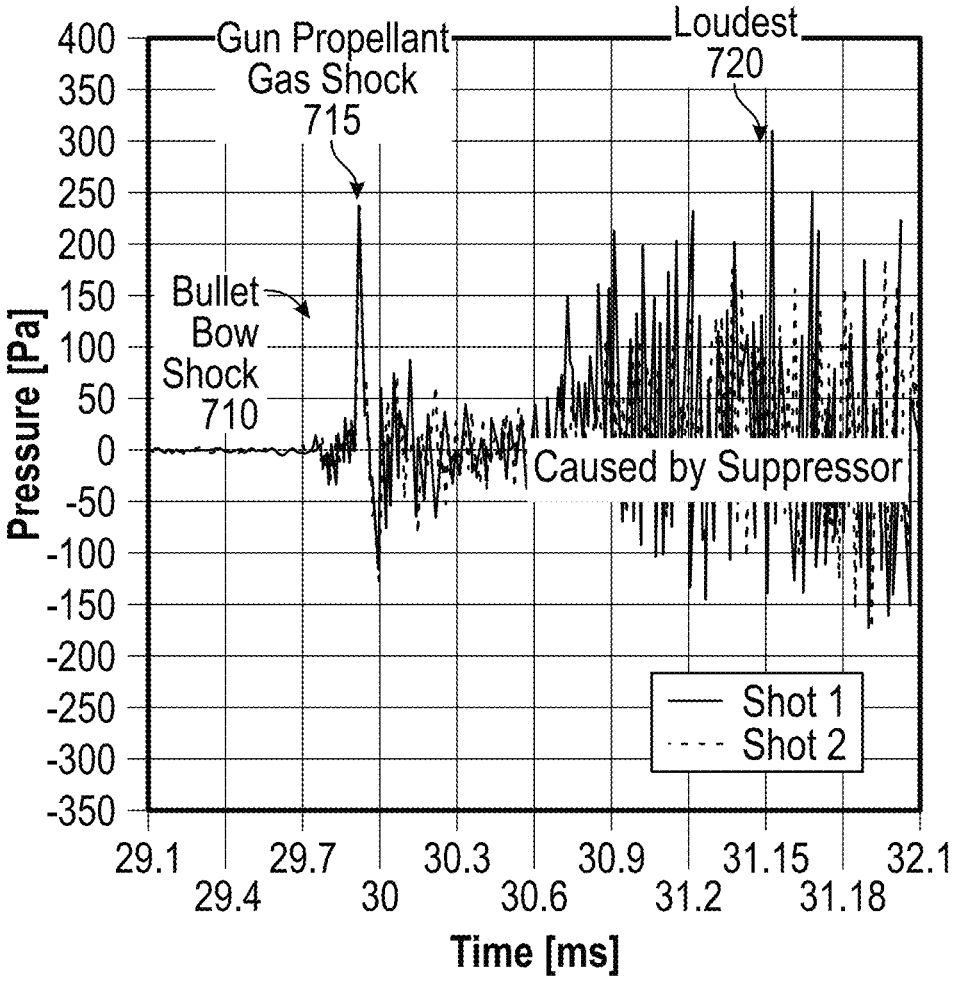
FIGS. 7A and 7B are visualizations showing pressure as a function of time for an example prior art suppressor with multiple baffles.
Figure 7B:
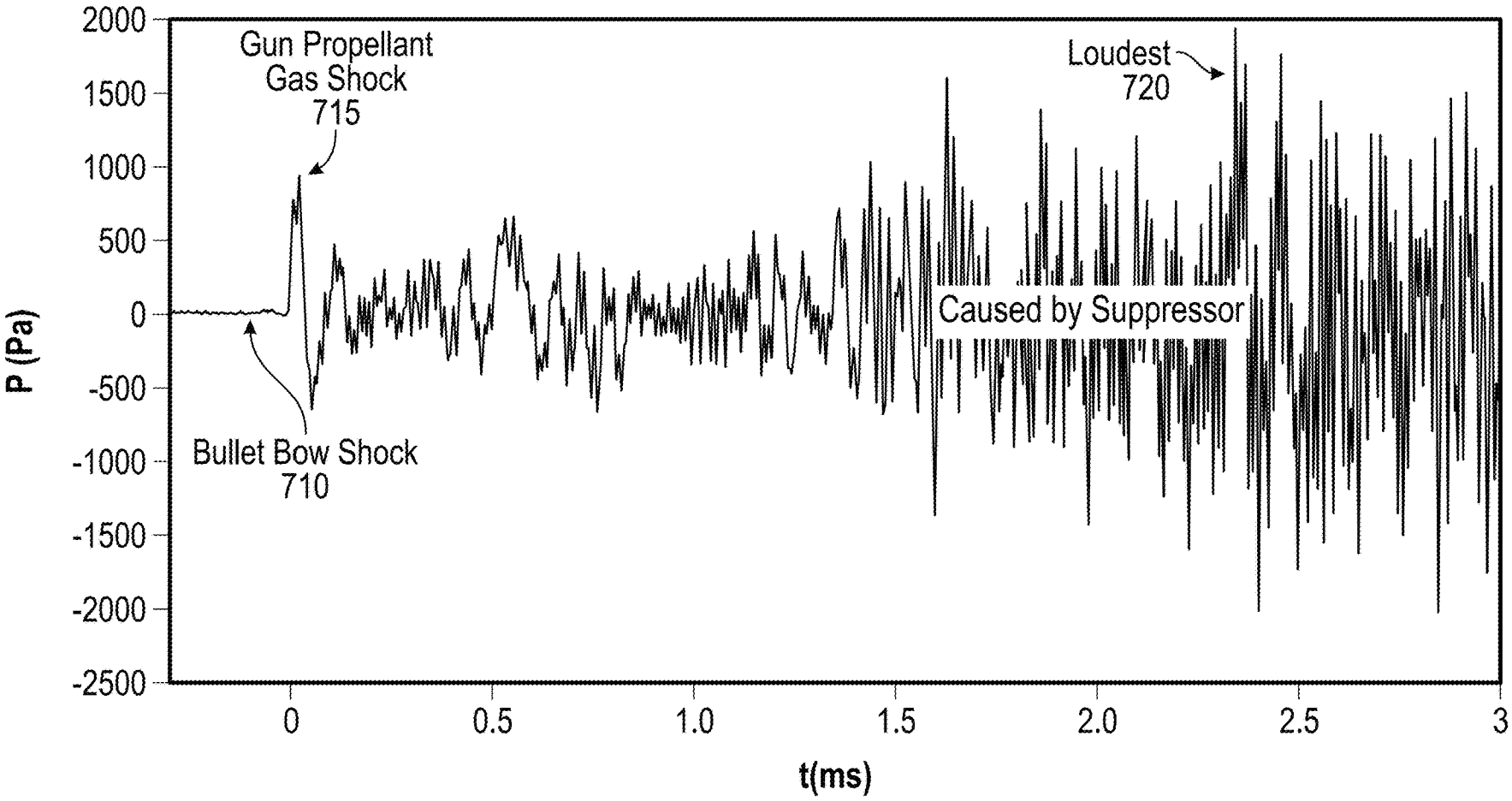

FIG. 7A depicts a graph of pressure vs. time based on what I believe to be real-world test results for a Banish 30 Gold suppressor manufactured by Silencer Central. FIG. 7B depicts a graph of pressure vs. time based on my real world tests of the Dead Air Wolfman suppressor (see FIG. 21). I believe that the Banish 30 Gold and Dead Air Wolfman suppressors are similar to basic suppressor 400. Both FIG. 7A and FIG. 7B show first area 710, second area 715, and third area 720. First area 710 is pressure that is caused by the bullet bow shock 160. Second area 715 is pressure that is caused by gun propellant gas shock 140. Third area 720 is the area of highest pressure (and sound) and is caused by the respective suppressor.

Figure 8:
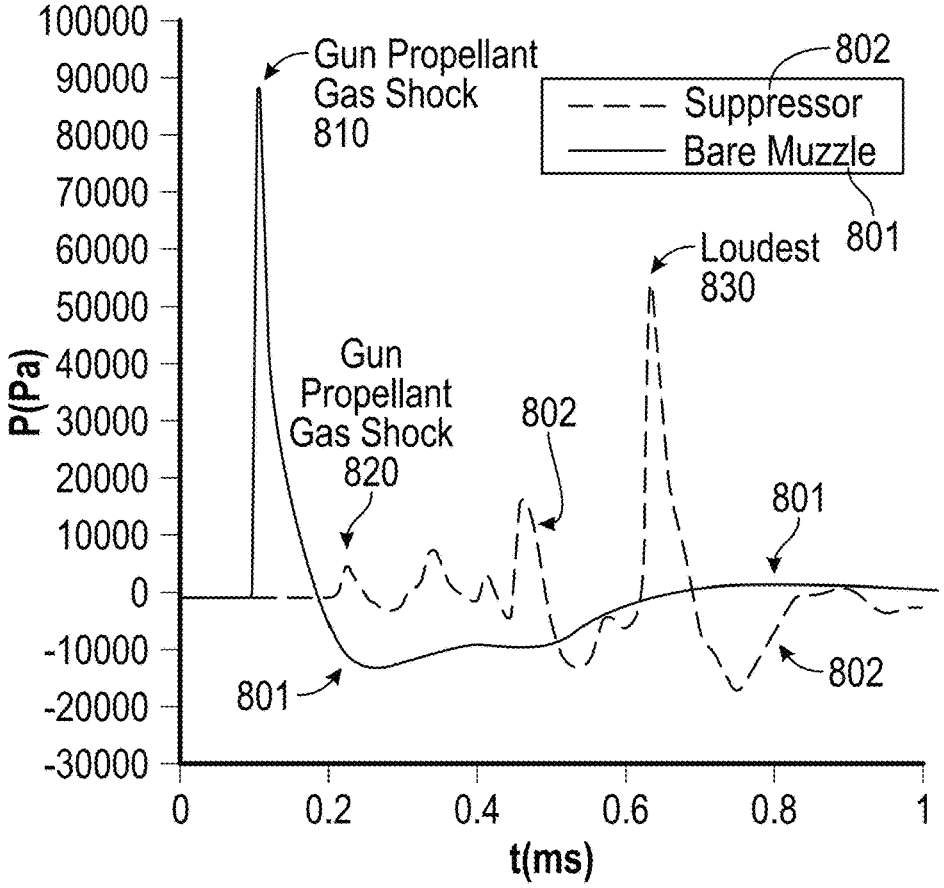
FIG. 8 is a demonstrative visualization comparing pressure as a function of time for an example prior art suppressor and a bare muzzle.

FIG. 8 depicts simulation results showing the relative performance of use of the prior art flat baffle suppressor depicted and discussed with reference to FIG. 4 and use of no suppressor (bare muzzle). First waveform 801 is a waveform showing pressure versus time for a bare muzzle firing, and second waveform 802 is a waveform showing pressure versus time for a suppressed firing. As shown, first waveform peak 810 is significantly higher than second waveform initial peak 820. This means that the suppressor reduced the sound detected as a result of gun propellant gas shock 140. However, as shown in FIG. 8, the prior art flat baffle suppressor's initial reduction of sound also results in the creation of second waveform secondary peak 830. Second waveform secondary peak 830 corresponds with third area 720. In other words, the prior art suppressor reduces sound but it also creates a delayed sound. I speculate that this delayed sound is created by reverberations of pressure inside the suppressor, which leads to reverberation of the external cone shock, as discussed above with reference to FIG. 3.

Figure 9A:
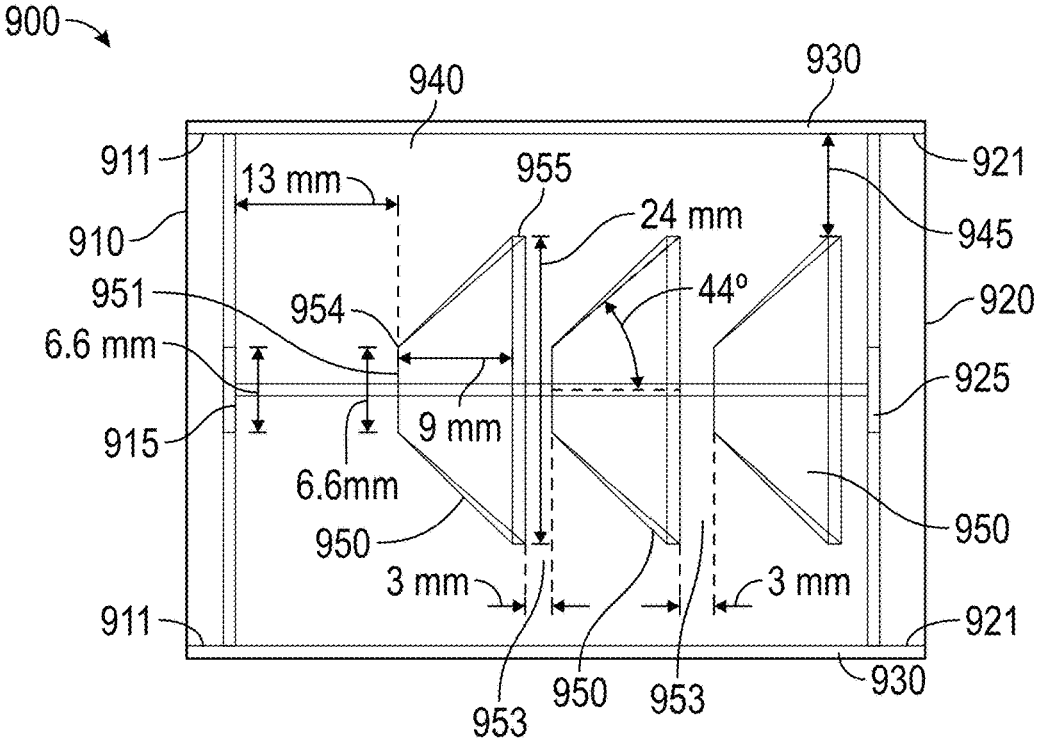
FIG. 9A is a side view of an exemplary embodiment a single-suppressor-barrel configuration of the disclosed invention.

FIG. 9A depicts a cross section of an exemplary embodiment of a blade chamber 900. In this embodiment, blade chamber 900 comprises entrance wall 910, exit wall 920, outer wall 930, interior space 940, three blades 950, and a plurality of support members 960 (not depicted in FIG. 9, but see FIG. 10). Entrance wall 910 further comprises entrance hole 915 and entrance wall threading 911. Exit wall 920 further comprises exit hole 925 and exit wall threading 921. In this embodiment, entrance wall 910, exit wall 920, and outer wall 930 define the outer boundaries of interior space 940. In this embodiment the space between the outermost portion of blade 950 and outer wall 930 defines a bypass 945.

As used herein, a blade 950 is a baffle for directing flow of gas inside blade chamber 900.

FIG. 9A also depicts blade narrow end 954, blade wide end 955, and blade gap 953. Blade narrow end 954 is the narrower end of each blade 950 and is closer to entrance wall 910. Blade wide end 955 is the wider end of each blade 950 and is closer to exit wall 920. The terms "wide" and "narrow" are used in this paragraph to refer to the conical frustum shape of each blade 950 and not the thickness of the blade itself, which in this embodiment is approximately constant as shown in FIG. 20B. Blade gap 953 is the space between blade wide end 955 of one blade 950 and the narrow end 954 of an adjacent blade 950. FIG. 9A depicts blade gap 953 as being 3 millimeters.

Figure 9D:
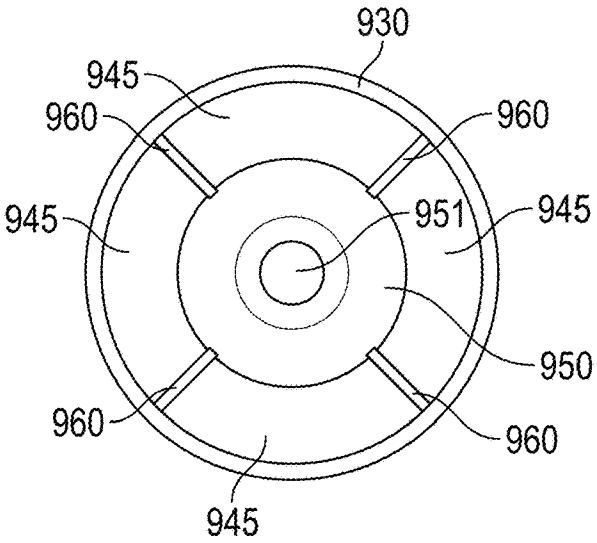
FIG. 9D is an axial cross-section of the disclosed invention showing an exemplary embodiment of a blade gap.
Figure 9C:
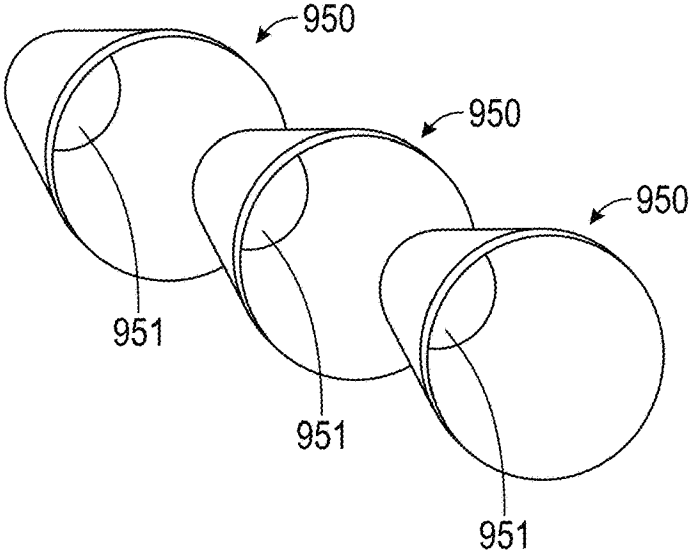
FIG. 9C is a perspective view of an internal blade of a configuration of the disclosed invention.
Figure 9B:
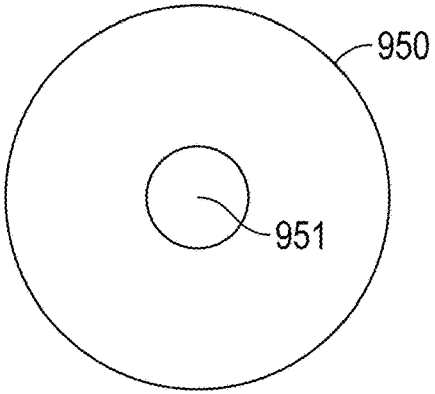
FIG. 9B is a front view of an internal blade of a configuration of the disclosed invention.

FIG. 9B depicts a front view of a blade 950. In this embodiment, blade hole 951 is circular.

FIG. 90 is a perspective view of three blades 950.

FIG. 9D is a front view of an axial cross section of a blade chamber at blade wide end 955. This view shows the size of bypass 945 at its narrowest point.

The measurements depicted in FIGS. 9A-D show one embodiment of the disclosed invention. However, other suitable measurements may be used. For example, in this embodiment, blade chamber 900 is cylindrically shaped, but other shapes may be used with suitable attachment mechanism. For example, I speculate that a blade chamber 900 in the form of an elliptical cylinder would perform similarly to a blade chamber 900 in the form of a circular cylinder.

Each blade 950 comprises a blade hole 951. Blade hole 951, entrance hole 915, and exit hole 925 are all large enough for a fired bullet or other projectile to pass through and have roughly the same inner diameter as diameter of the gun barrel 120 used.

Each blade 950 is generally shaped like the surface of a conical frustum, but the disclosed invention is not limited to conically-shaped blades 950. Varying shapes of blade 950 are discussed with reference with FIGS. 15A, 15B, 150, and 15D.

While the depicted embodiment shows three blades 950, other numbers of blades may be used. For example, one, two, three, four, five, six, seven, eight, nine, ten, eleven, twelve, thirteen, fourteen, fifteen, sixteen, seventeen, eighteen, nineteen, and twenty blade 950 configurations may be used for a blade chamber 900.

Varying dimensions of bypass 945 are discussed with reference to FIGS. 17 and 18.

In an exemplary embodiment, blade chamber 900 is made of stainless steel. Other suitable materials capable of maintaining form in view of pressures and temperatures experienced may be used.

The foregoing description with respect to the interior of each blade 950 provides a means for reducing cone shock of gas escaping from a suppressor as well as for reducing the resulting vibrations, cone shock reverberations, and sound.

Figure 10:
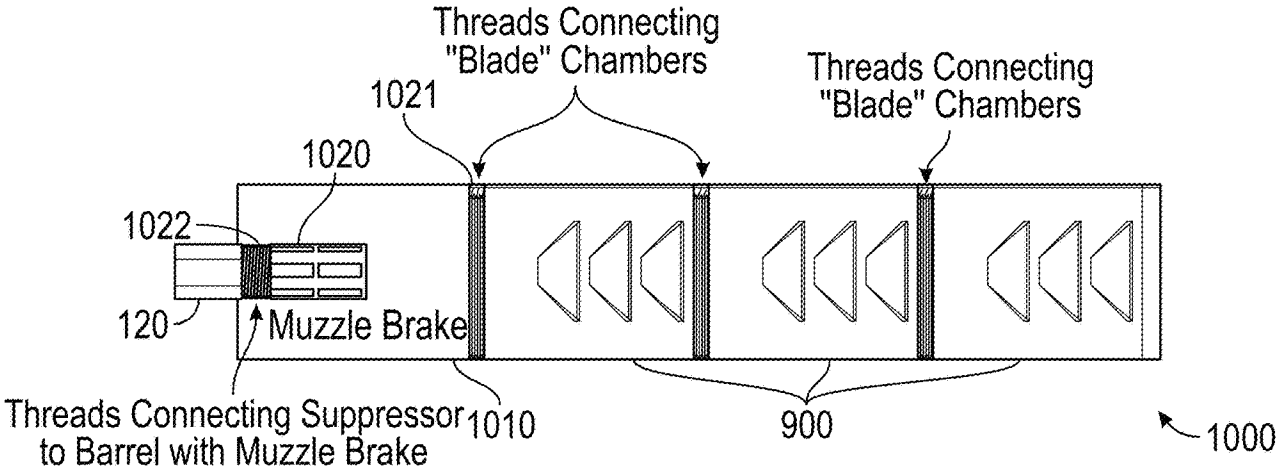
FIG. 10 is a side view of an exemplary embodiment of a three-suppressor-chamber configuration of the disclosed invention.

FIG. 10 depicts a side cross-sectional view of an embodiment of suppressor 1000. In this embodiment, suppressor 1000 comprises three blade chambers 950 and a brake chamber 1010. Brake chamber 1010 further comprises a muzzle brake 1020, brake chamber exit wall threading 1021, and brake threading 1022, The blade chambers 900 and brake chamber are connected together via entrance wall threading 911, exit wall threading 921, and brake chamber exit wall threading 1021. Suppressor 1000 is connected to gun barrel 120 via brake threading 1022.

Although this embodiment depicts three blade chambers 900, other numbers of blade chambers may be used, and blade chambers 900 can be used with other chambers, such as empty chambers or flat baffle chambers, non-limiting examples of which are depicted in FIGS. 4, 19A, and 19B.

Figure 11:
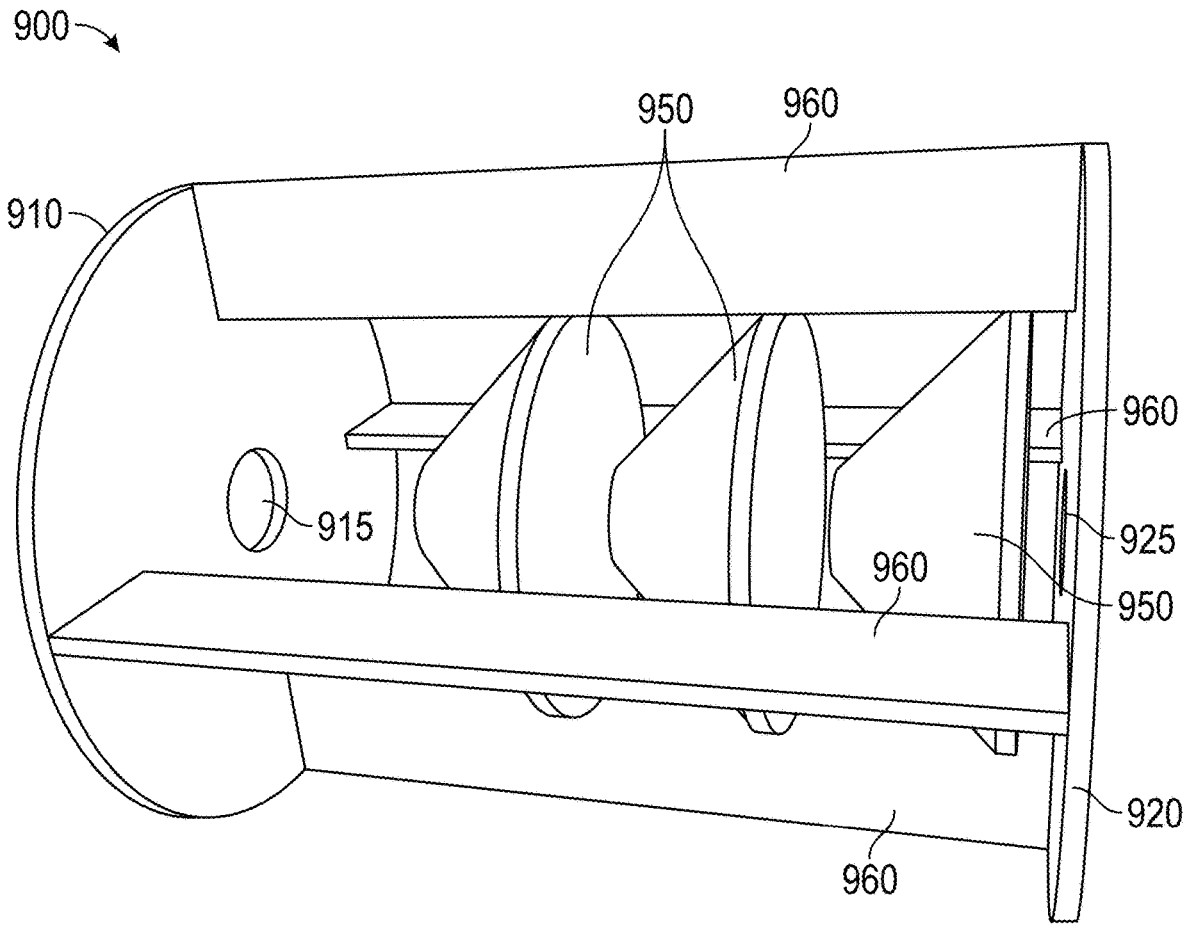
FIG. 11 is a perspective view of an exemplary embodiment of a single-suppressor-chamber configuration of the disclosed invention with the suppressor walls not shown.

FIG. 11 depicts a perspective view of an exemplary embodiment of a blade chamber 900 and shows four support members 960. The support members 960 attach both to each blade 950 and to outer wall 930 (depicted in FIG. 9*a*); and the support members 960 hold the blades 950 in place.

Figure 12A:
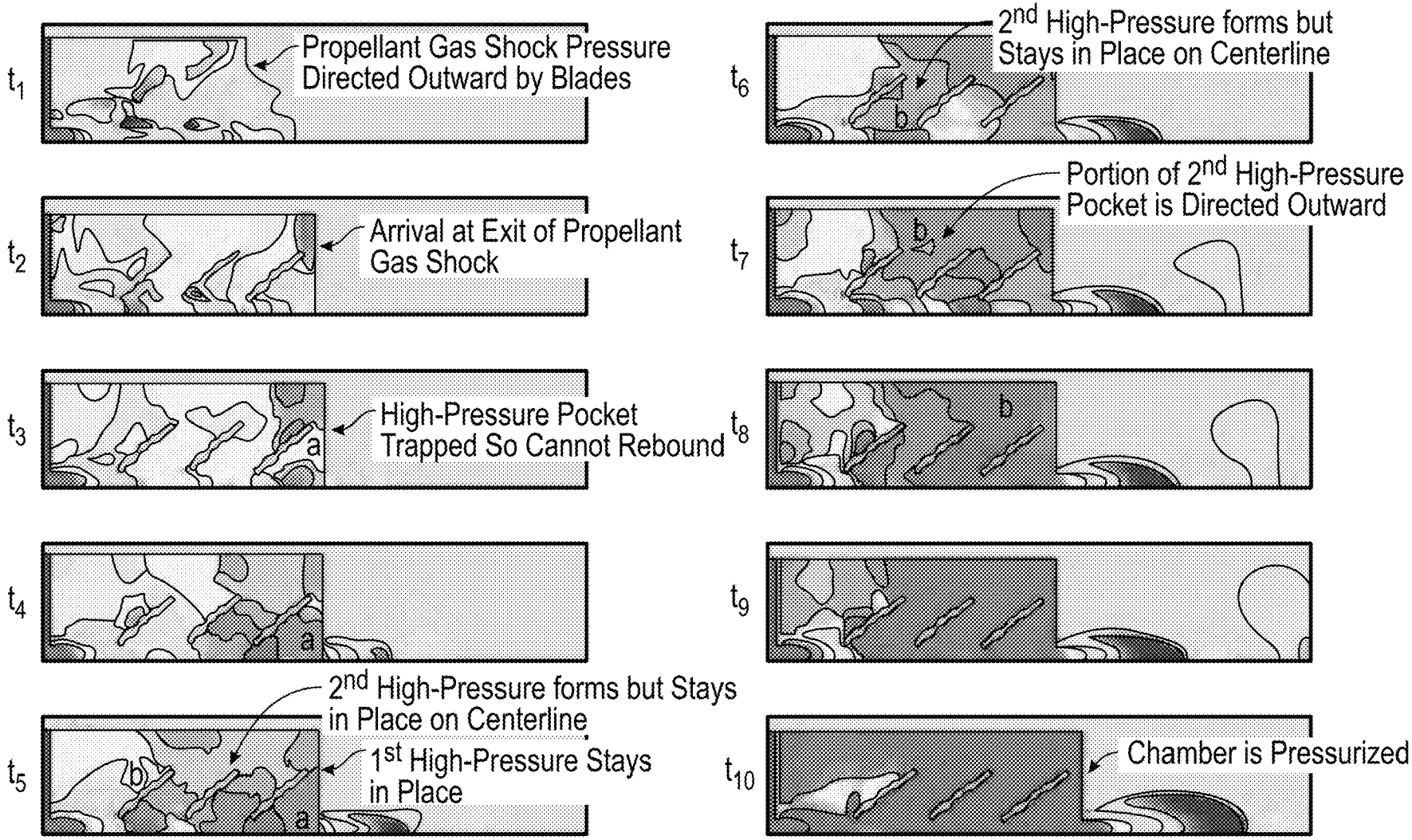
FIGS. 12A and 12B are different illustrations of the same time sequence of side views of a simulation of pressure as a bullet is fired from a gun through an exemplary embodiment of the disclosed invention.
Figure 12B:
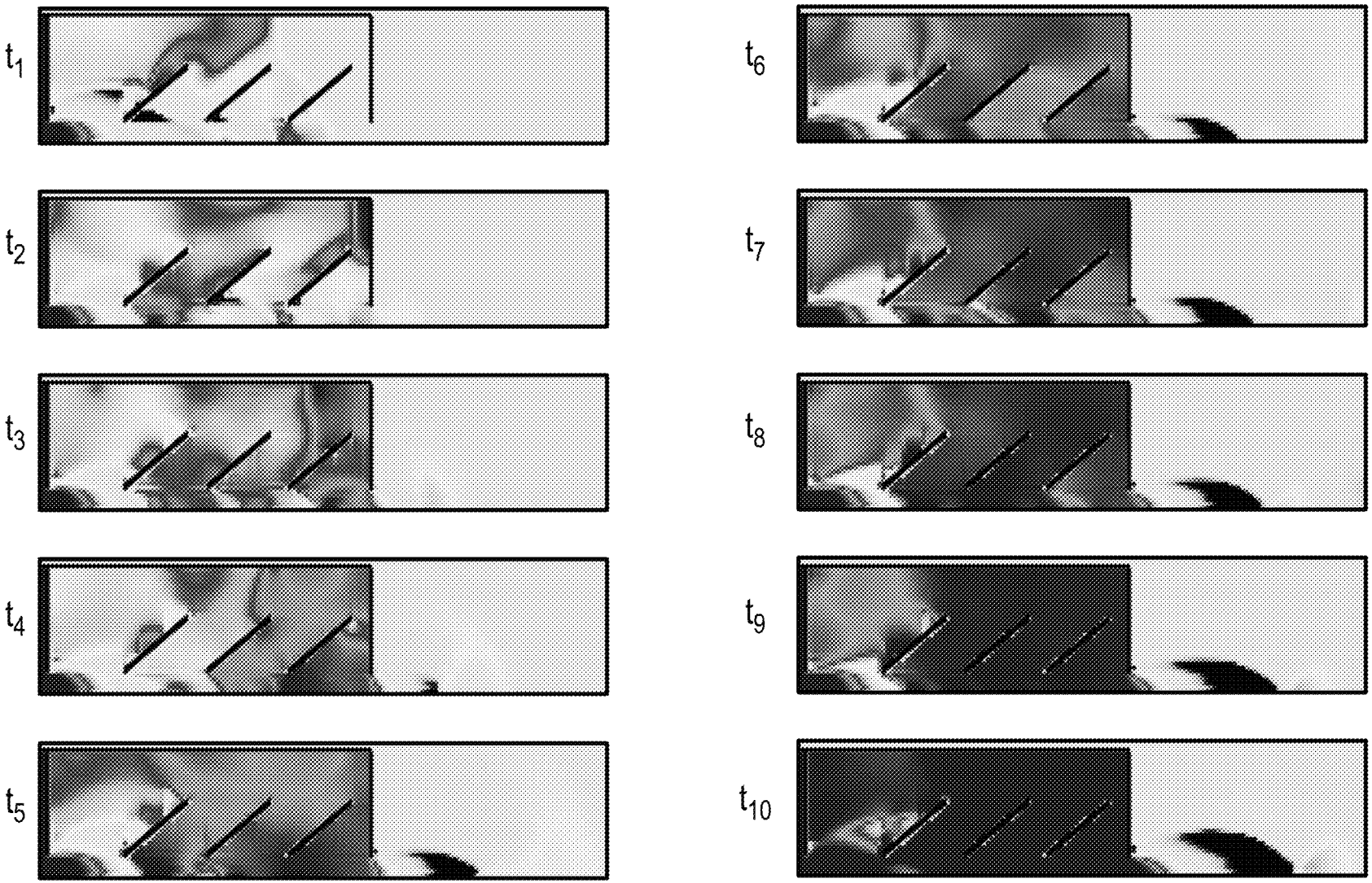

FIGS. 12A and 12B depict the same time sequence of a simulation of pressure inside a single blade chamber 900 immediately after a bullet 110 has been fired and passed through the suppressor moving from the left to the right. The difference between FIGS. 12A and 12B is that FIG. 12A is a line drawing containing shaded segments, whereas FIG. 12B shows the output of a simulation upon which FIG. 12A is based. As depicted in FIGS. 12A and 12B, the darkness in each image is a function of pressure. The time sequence shows the following:

- At t1, the high pressure is traveling towards the exit but is directed outward laterally towards the outer wall 930.
- At t2, the high pressure has traveled towards exit wall 920.
- At t3, the high pressure has built up along exit wall 920. I speculate that, at this point, the high pressure is trapped by blades 950 and so the rebound is limited.
- At t4, the high pressure fills the volume between two blades 950.
- At t5 through t7, a second high pressure volume ("b") is formed and as the high pressure volume moves toward the first high pressure volume ("a") the second high pressure volume ("b") is directed outward laterally towards outer wall 930 by a blade 950 instead of traveling towards exit wall 920 (and, I speculate that the high pressure volume not hitting exit wall 920 results in the high pressure volume not causing pulsing of the cone shock).
- At t8 through t10, the pressure smoothly fills the entire chamber, avoiding reverberations that I speculate are the cause of the poor performance discussed above.

Figure 13B:
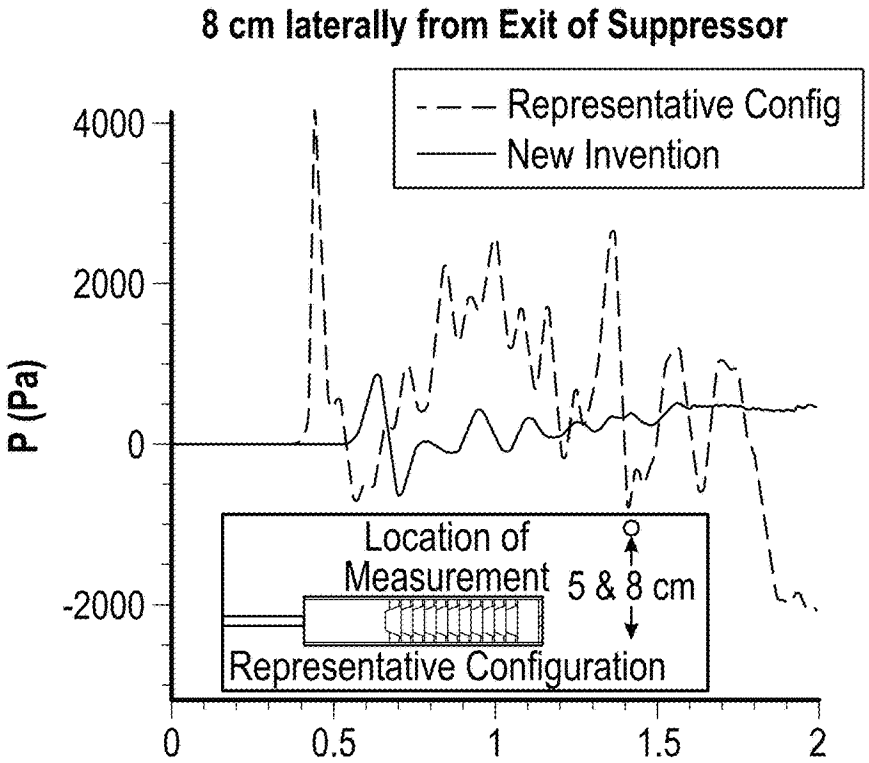
FIGS. 13A and 13B depict comparisons of pressure as a function of time for an example prior art design and for an embodiment of the disclosed invention.
Figure 13A:
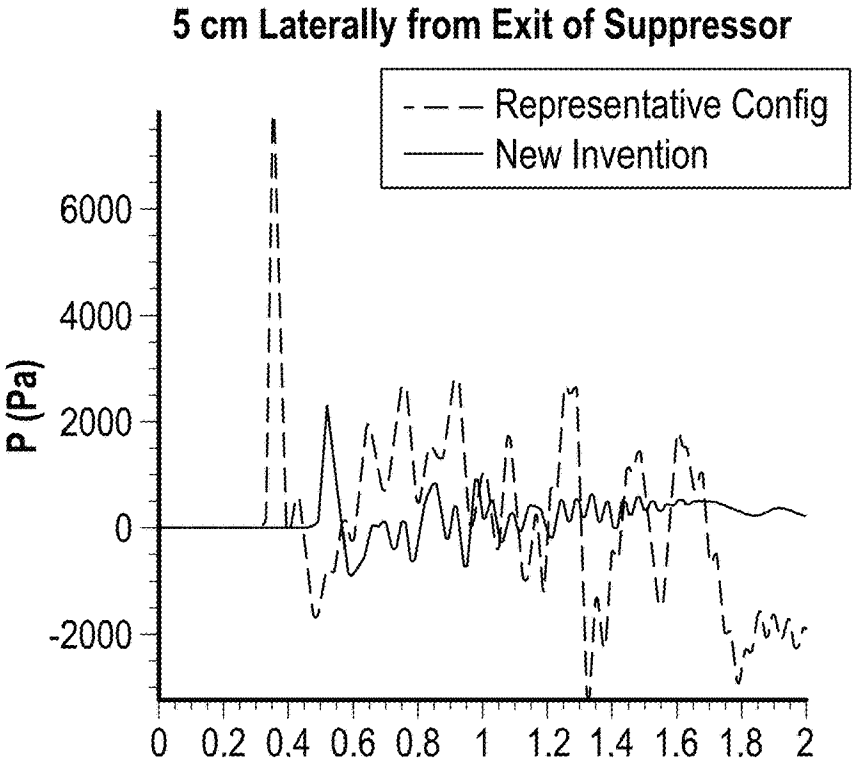

FIGS. 13A and 13B show comparative simulation results comparing the three-chamber blade design shown in FIG. 10 with the suppressor design shown in FIG. 6. The simulations for FIGS. 13A and 13B were performed by simulating the firing of a 5.56 mm rifle and measuring the results with virtual pressure at 5 cm and 8 cm laterally from the bullet path at a distance of 0 cm from the end of the suppressor. These simulation results show that the disclosed blade configuration is an improvement against the representative configuration, as the initial gun propellant gas shock is reduced and because the additional noise, that I speculate is created by reverberations within the suppressor which drives the motion of the external cone shock, is also reduced. With reference to FIGS. 13A and 13B, the representative configuration is based on the design of the Banish 30.

Figure 14:
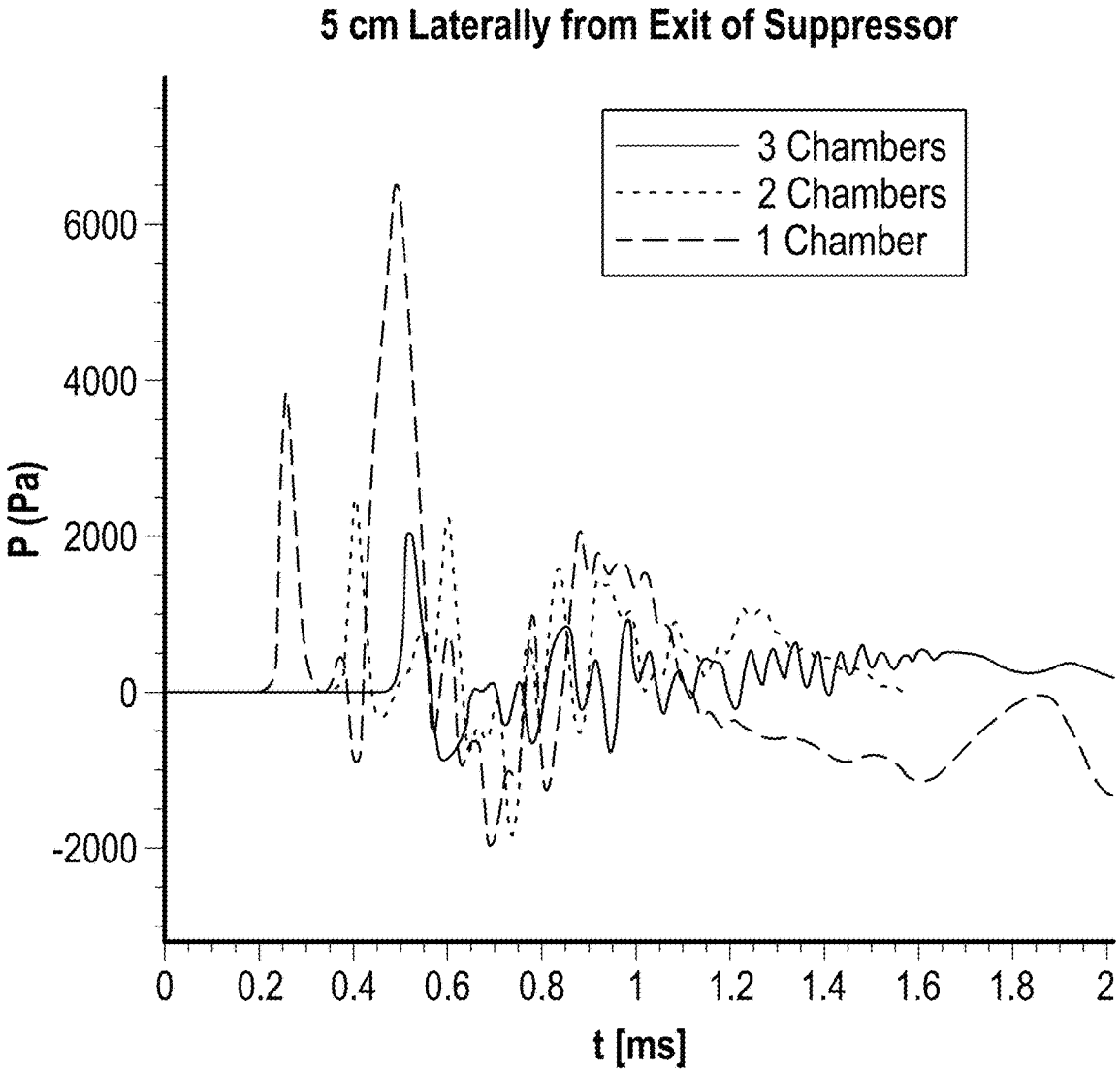
FIG. 14 depicts pressure as a function of time for one, two, and three chamber embodiments of the disclosed invention.

FIG. 14 shows comparative simulations performed in the same fashion as the simulated tests shown in FIGS. 13A and 13B, except these simulations compare suppressors having one, two, and three blade chambers, respectively. The results show that increasing the number of blade chambers increases the overall performance of the suppressor.

Figure 15A:
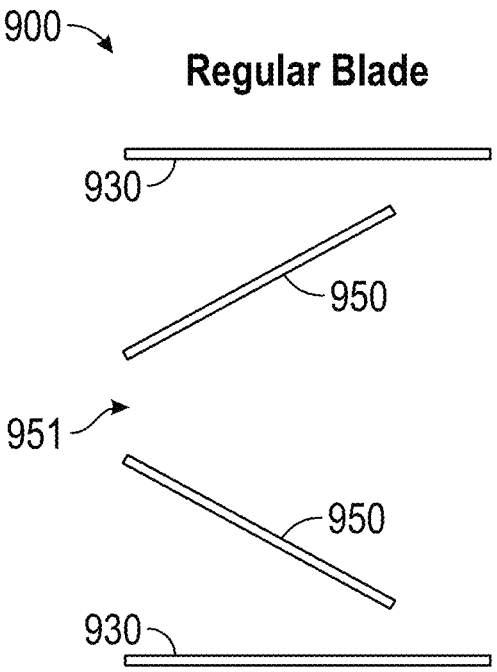
FIGS. 15A, 15B, 15C, and 15D depict cross sectional views of embodiments of pressure diversion blades.
Figure 15B:
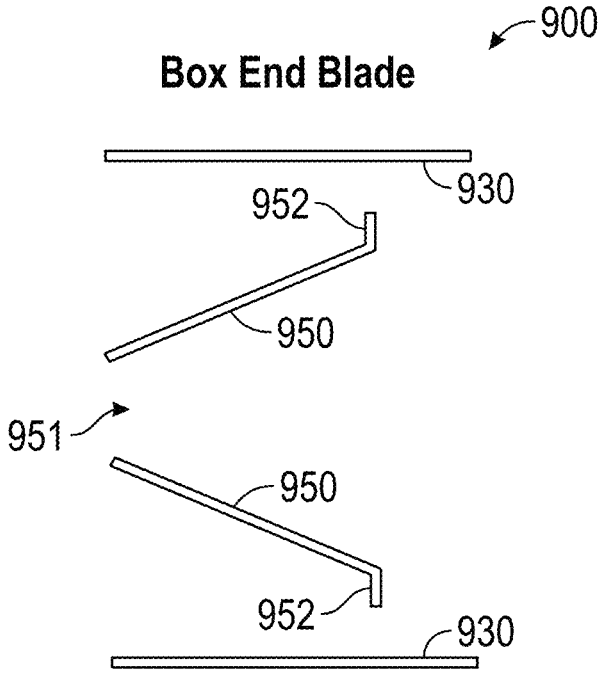
Figure 15C:
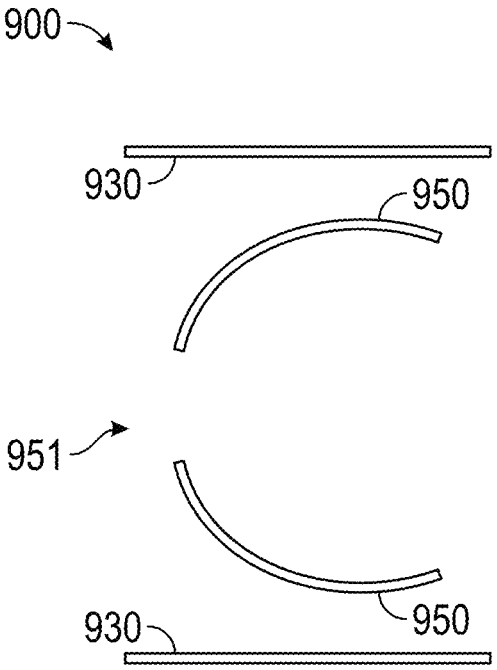
Figure 15D:
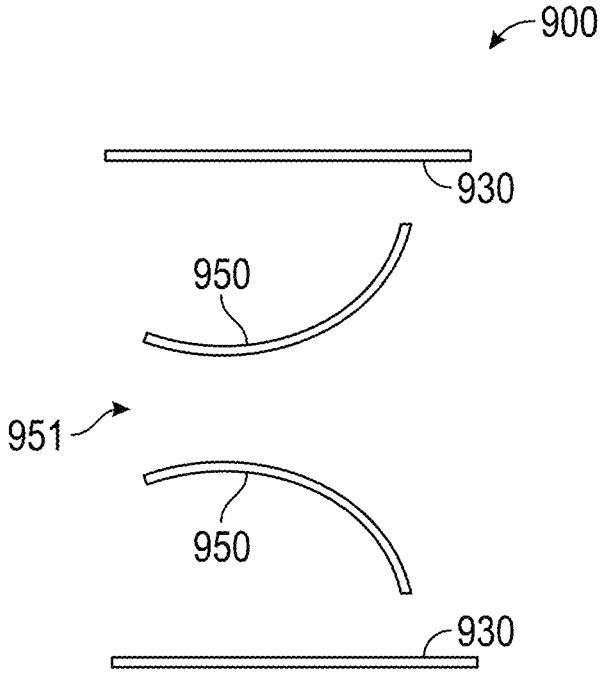

FIGS. 15A, 15B, 15C, and 15D each depict a side cross section of an embodiment of a blade chamber 900. The blade chamber 900 in FIG. 15A has blades 950 that are straight. The blade chamber 900 in FIG. 15B has blades 950 that include blade flare 952, referred to in the figures as a "box end blade." The blade chambers 900 in FIGS. 15C and 15D have blades 950 that are curved concave (FIG. 15C) or curved convex (FIG. 15D).

In the exemplary embodiments shown in FIGS. 15C and 15D, the curved blades 950 (wither convex or concave) are segments of an ellipse according to the following formula, wherein "x" is the distance along the axis of the suppressor (i.e., the bullet path) and "y" is the radius from the axis, and the other parameters are listed below in Table 1:

$$\frac{(x-h)^2}{a^2}+\frac{(y-k)^2}{b^2}=1$$

TABLE 1

Parameters for Ellipse Segments of FIGS. 15C and 15D

| | Parameter "h" | Parameter "k" | Parameter "a" | Parameter "b" |
|---|---|---|---|---|
| Concave | 0.0720 m | 0.0350 m | 0.0090 m | 0.0860 m |
| Convex | 0.0630 m | 0.0121 m | 0.0090 m | 0.0860 m |

Figure 16:
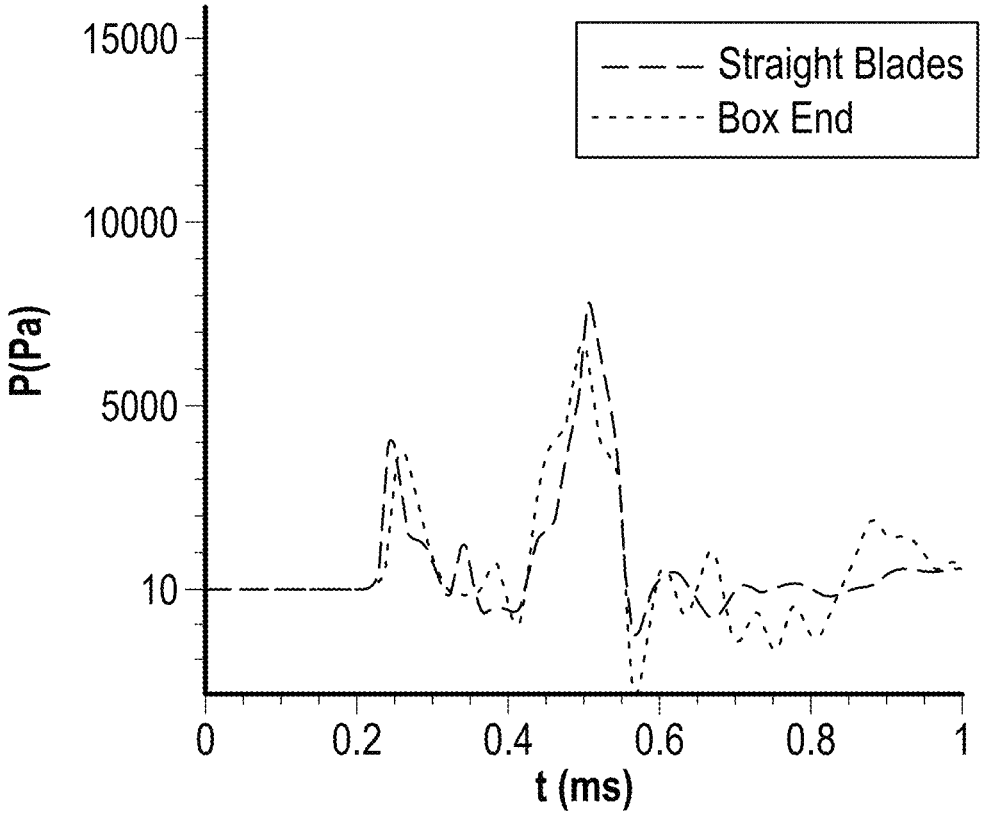
FIG. 16 depicts pressure as a function of time for suppressors incorporating the embodiments of pressure diversion blades discussed in relation to FIGS. 15A and 15B.

FIG. 16 shows comparative simulated test results performed in the same fashion as the simulations shown in FIGS. 13A, 13B, and 14, except these results compare suppressors having a single blade chamber 900, each with three of the blades 950 as depicted in FIG. 15. The results show that the straight blades have slightly better performance than "box end blades," that is, blades 950 shaving blade flare 952.

Figure 17A:
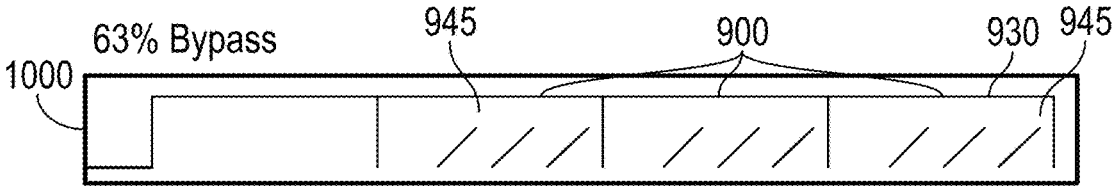
FIGS. 17A, 17B, and 17C depict partial cross sectional views of three different three-chamber suppressors having different bypass sizes.
Figure 17B:
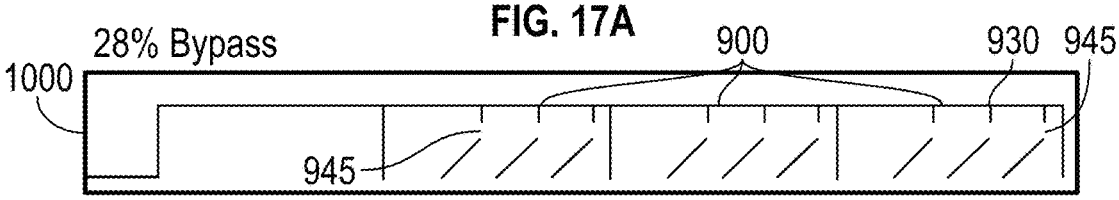
Figure 17C:
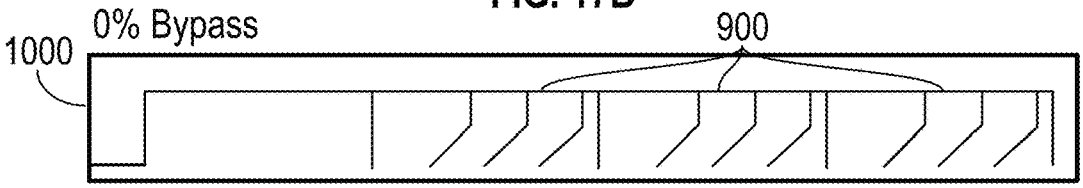

FIGS. 17A, 17B, and 17C depict suppressors 1000 with varying sizes of bypasses 945. As used herein, the size of bypasses 945 is described as the percentage of the cross-sectional area perpendicular to the longitudinal axis (also referred to as a "central" axis) of the suppressor 1000 taken that is between blade wide end 955 (i.e., the distal end) of the blade 950 and the outer wall 930. The location of the cross section for calculating the percentage size of the bypass 945 is the same location as the cross section depicted in FIG. 9D. In one exemplary embodiment, the cross-sectional area of the suppressor 1000 is about 1216 square millimeters, and the open area between the distal end of the blade 950 and the outer wall 930 is about 766 square millimeters, leading to a bypass 945 size of about 63 percent. As used herein and in the claims, the cross-sectional area percentages do not account for the size of the support members 960.

Figure 18:
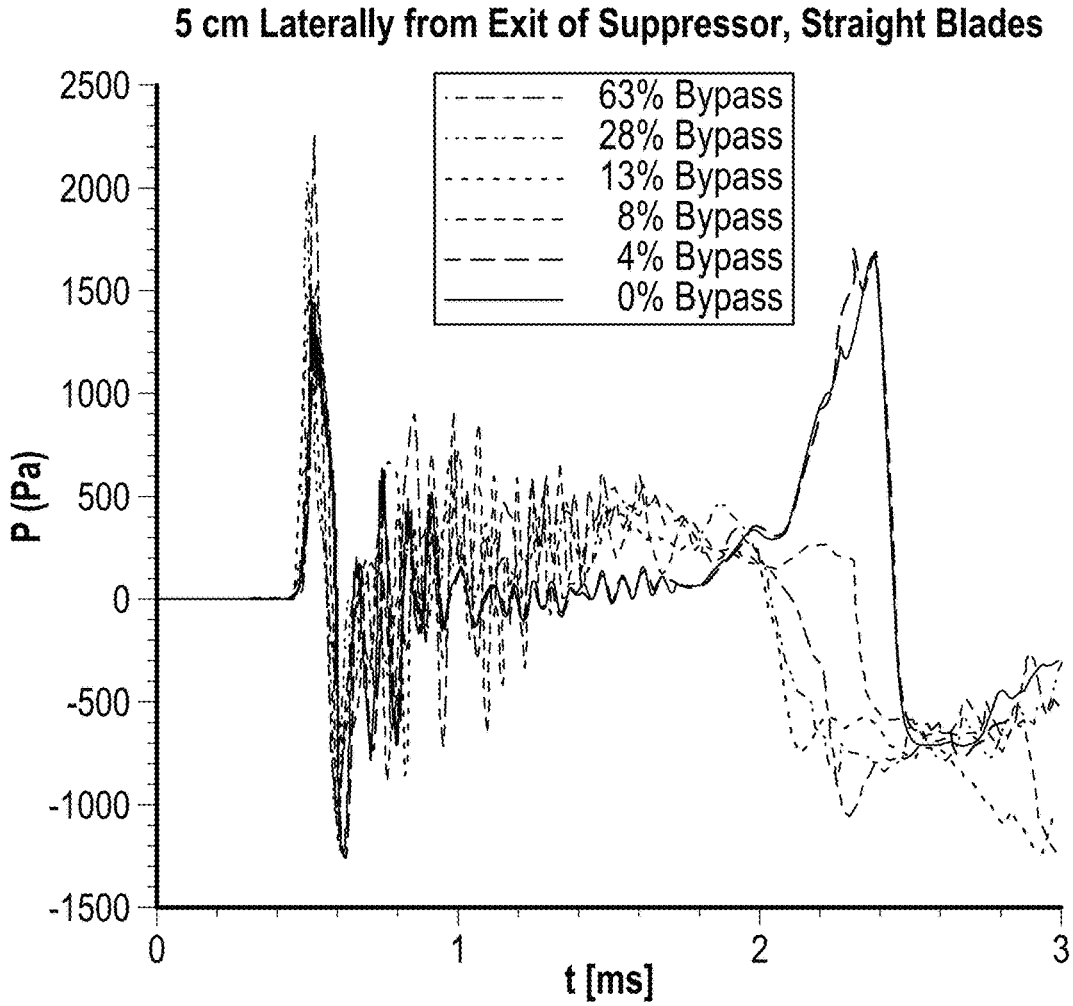
FIG. 18 depicts pressure as a function of time for three-chamber suppressors with pressure diversion blades having various bypass sizes.

FIG. 18 shows comparative results of simulated tests performed similarly to those shown in prior figures, except these results show suppressors 1000 having various bypass 945 sizes. These simulated results show significantly improved performance when the bypass 945 size is 8%, 13%, 28%, and 63%; however, I speculate that 9%, 10%, 11%, 12%, 14%, 15%, 16%, 17%, 18%, 19%, 20%, 21%, 22%, 23%, 24%, 25%, 26%, 27%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, and 62%, will also work, Thus, for guns firing 5.56×45 mm NATO rounds as simulated, tested, and discussed herein, working embodiments of the invention need to have bypass of at least 8%, but I speculate that the percentages could change for different caliber bullets, FIGS. 19A and 19B show suppressors 1000, with FIG. 19B showing a suppressor 1000 having two blade chambers 900 and one flat baffle chamber 956. Flat baffle chamber 956 is similar to the chambers in basic suppressor 400.

Figure 19C:
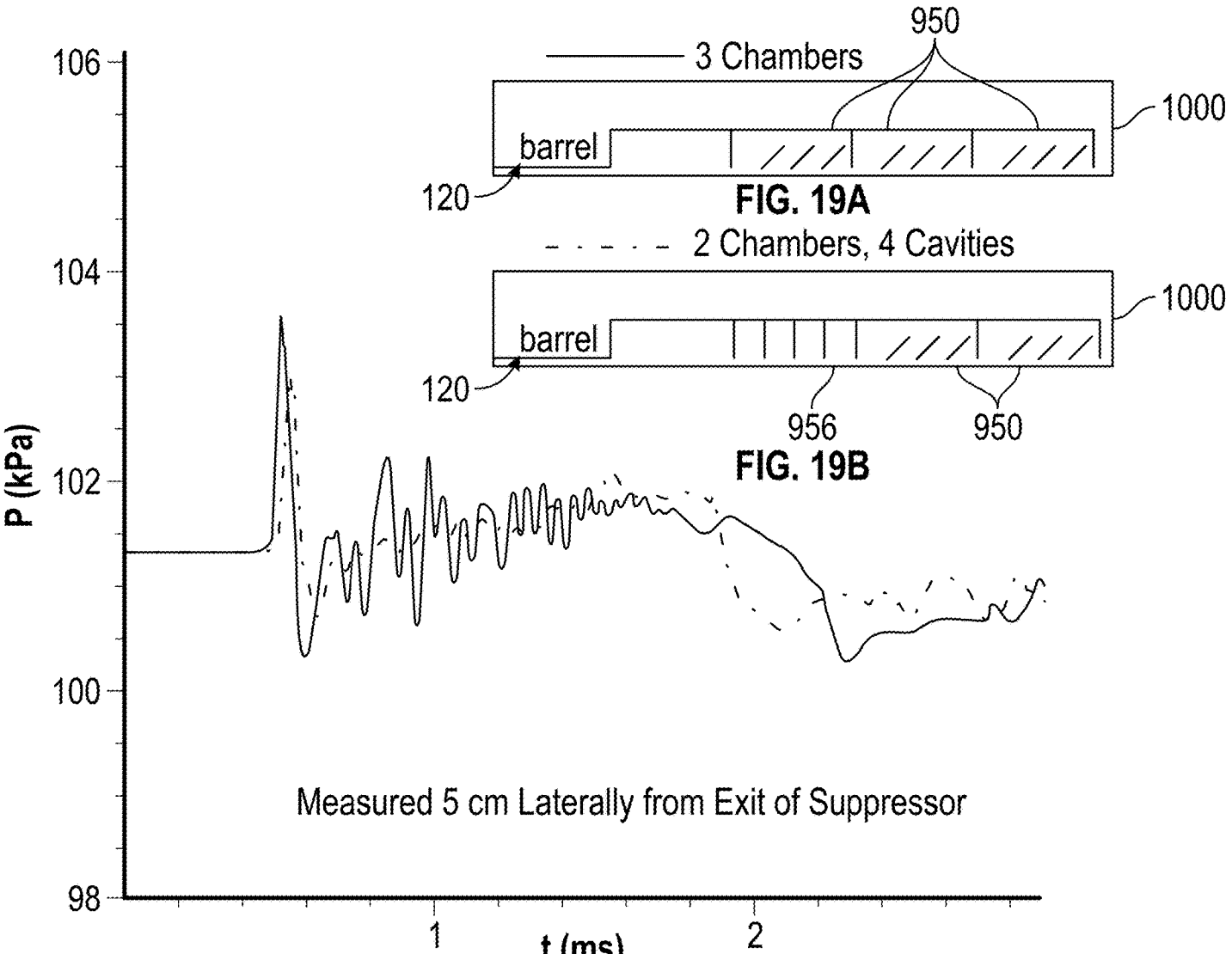
FIG. 19C depicts pressure as a function of time for the suppressors depicted in FIGS. 19A and 19B.

FIG. 19C shows comparative results of simulated tests performed similarly to those shown in prior figures, except these results show suppressors 1000 in the configurations depicted in FIGS. 19A and 19B. These results show that combinations of flat baffle chambers 956 and blade chambers 900 can both have good performance.

Figure 20A:
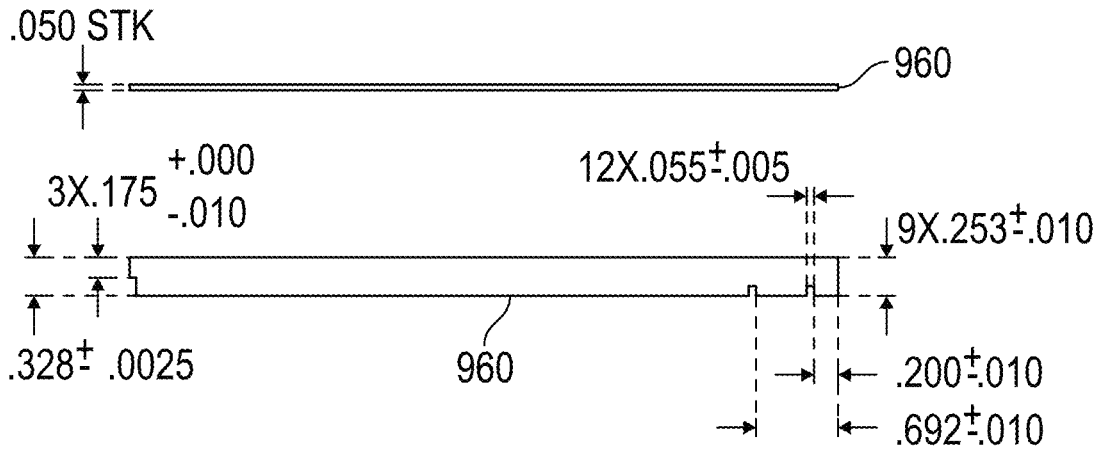
FIG. 20A depicts top and side views of a support member.
Figure 20B:
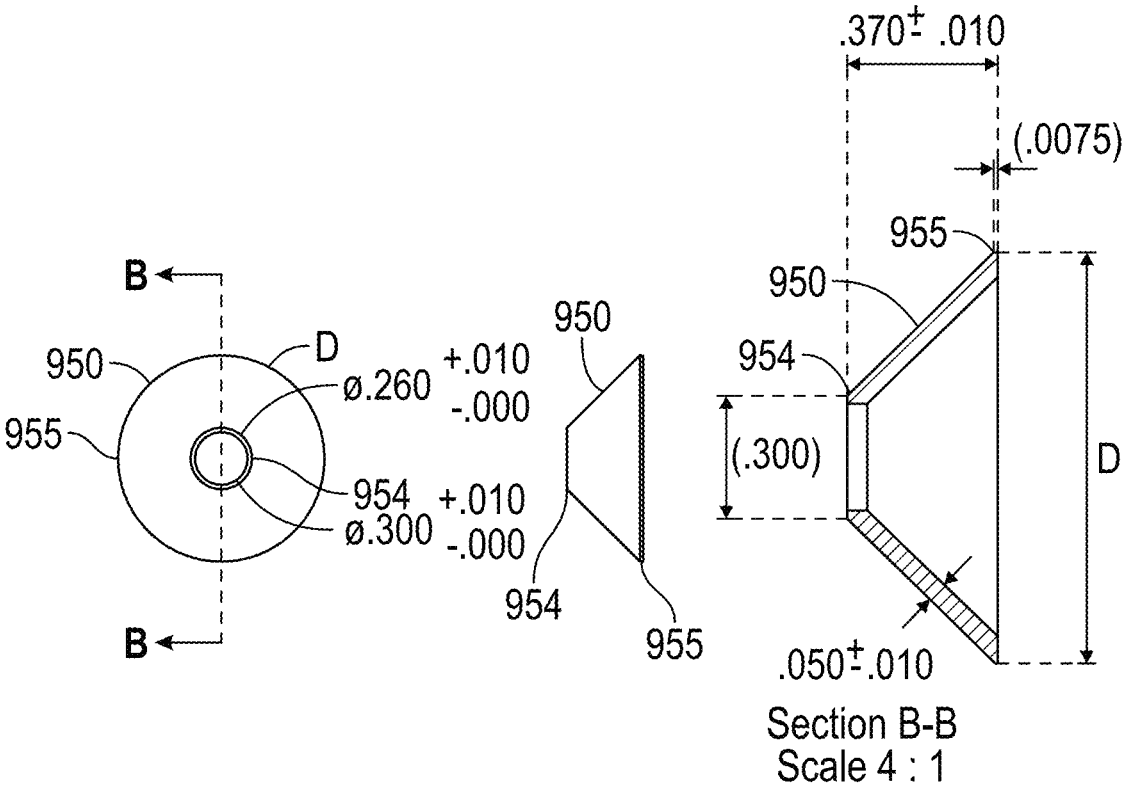
FIG. 20B depicts front and side views of a blade.
Figure 20C:
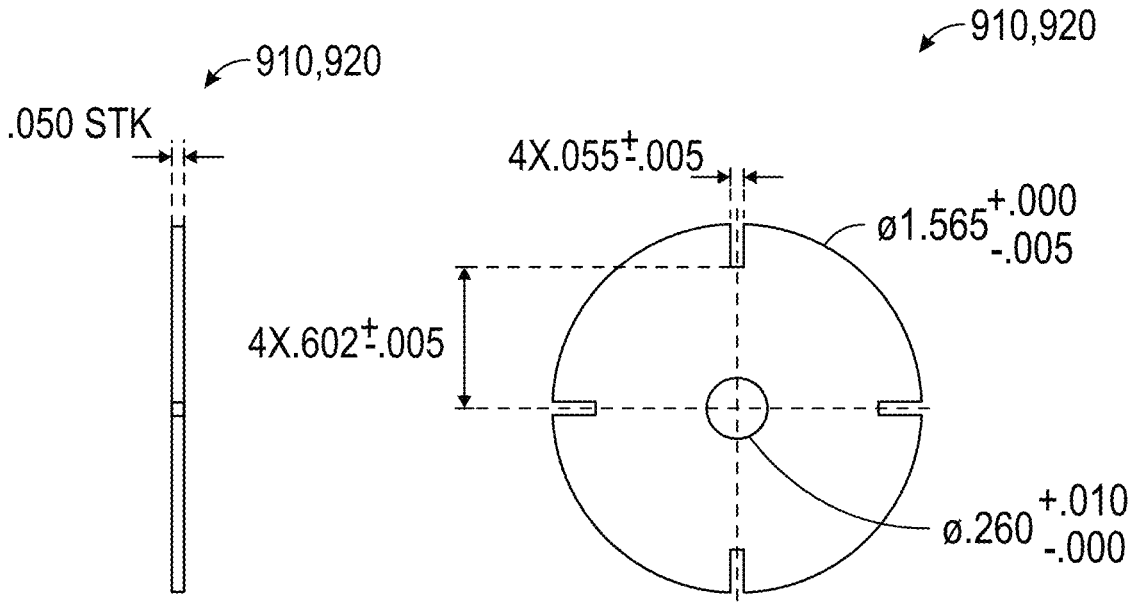
FIG. 20C depicts front and side views of an entrance wall and/or an exit wall.

FIG. 20A depicts top and side views of an exemplary embodiment of support member 960.

FIG. 20B depicts front and side views of an exemplary embodiment of a blade 950.

Figure 20D:
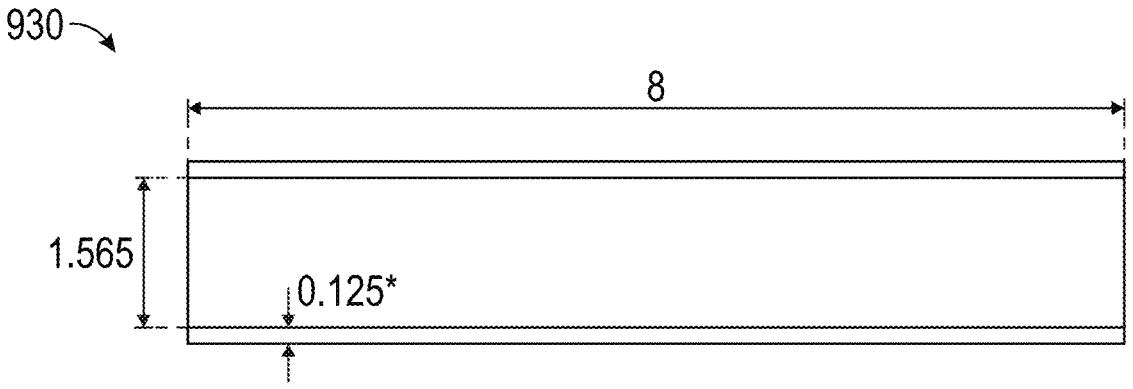
FIG. 20D depicts a side cross-sectional view of an outer wall.

FIG. 200 depicts front and side views of an exemplary embodiment of an entrance wall 910 and/or an exemplary embodiment of an exit wall 920, FIG. 20D depicts a side cross-sectional view of an outer wall 930.

FIGS. 20A-20D show dimensions for exemplary embodiments of support member 960, blade 950, entrance wall 910, exit wall 920, and outer wall 930, as well as a range of possible dimensions for embodiments of same.

Figure 21:
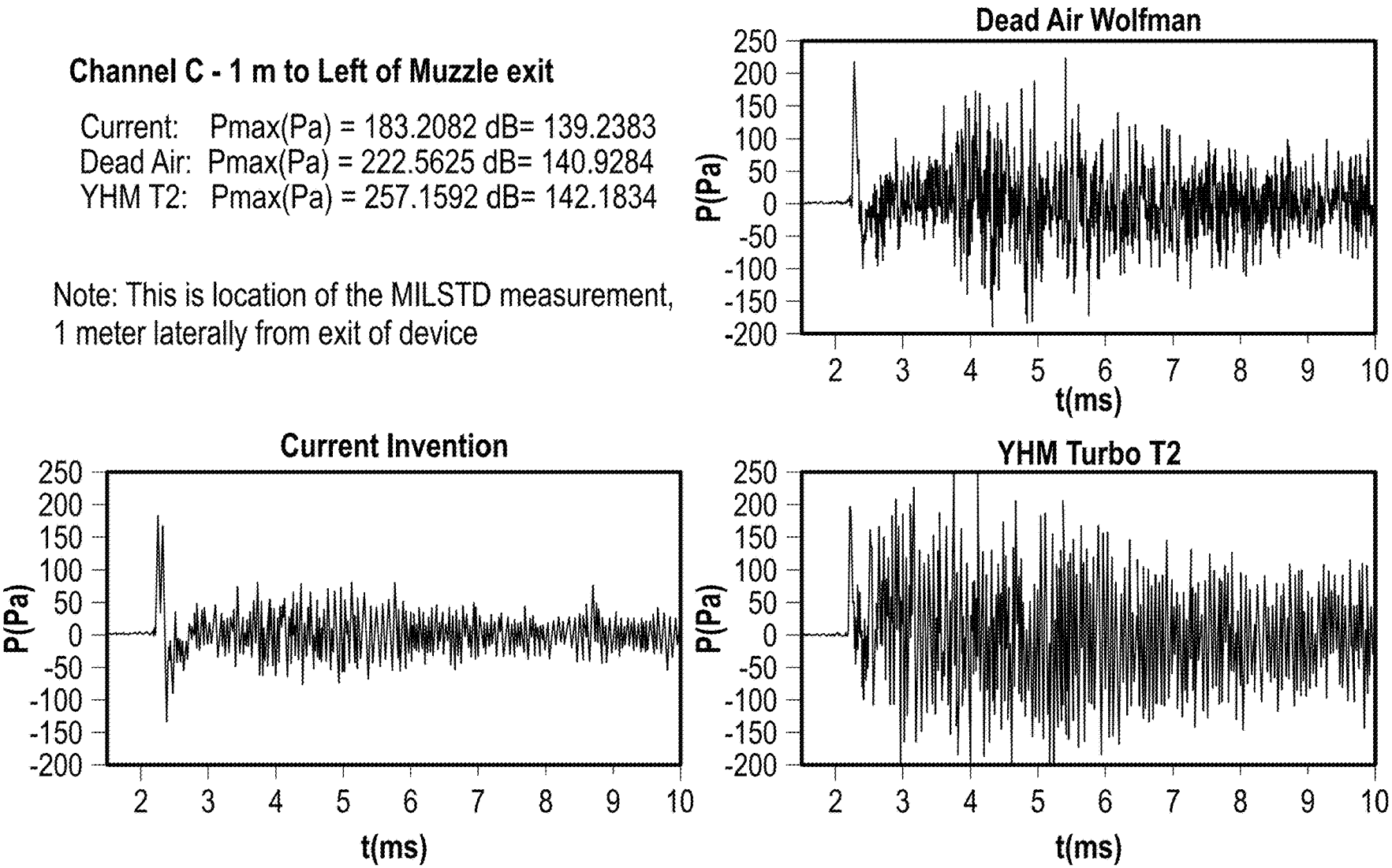
FIG. 21 depicts real-world test results of an embodiment of the disclosed invention.

FIG. 21 and Tables 1 and 2, below, show real-world test results of embodiment of the disclosed invention shown in FIG. 10 (without the muzzle brake), the commercially available Dead Air Wolfman brand suppressor, and the commercially available YHM Turbo T2 brand suppressor. These real-world tests were performed to Military Standard 1474 Rev. D (MIL-STD-1474D).

TABLE 2

Comparison of test data measured at the 1 meter (Military Standard).

| | Bare Muzzle | Dead Air Wolfman | YHM Turbo T2 | Embodiment of the Disclosed Invention |
|---|---|---|---|---|
| Peak P (Pa) | 4293 | 222.5 | 257.2 | 183.2 |
| % Reduction from Bare | | 95% | 94% | 96% |
| % Reduction from Comm #1 | | | | 18% |
| % Reduction from Comm #2 | | | | 29% |

TABLE 3

Comparison of test data at 12 cm from exit with simulation results.

| | Dead Air Wolfman | YHM Turbo T2 | Banish 30 | Embodiment of the Disclosed Invention |
|---|---|---|---|---|
| Peak P (Pa), Measured in Test, 12 cm from exit | 1936 | 3046 | | 894 |
| Peak P (Pa), Simulated, 8 cm from exit | | | 2640 | 856 |

Figure 22A:
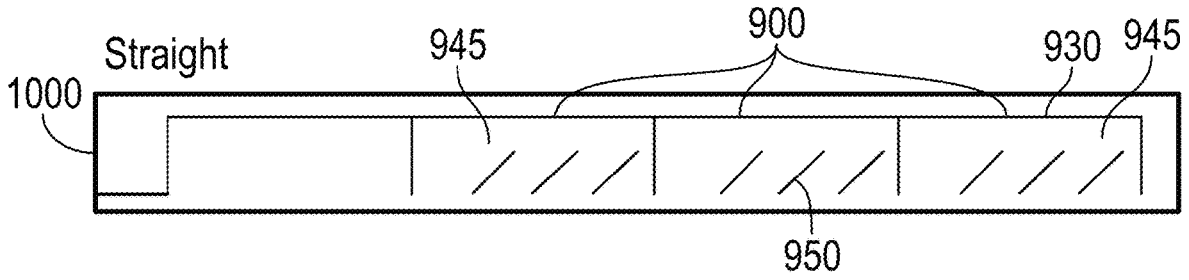
FIGS. 22A, 22B, and 22C depict partial cross sectional views of three different embodiments of three-chamber suppressors, each having different blade shapes.
Figure 22B:
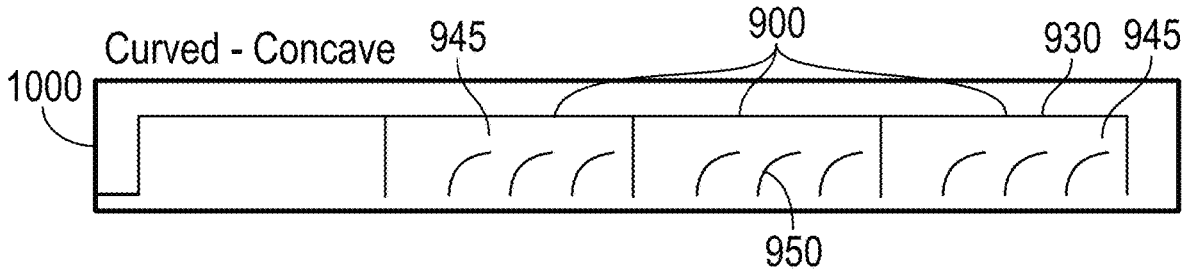
Figure 22C:
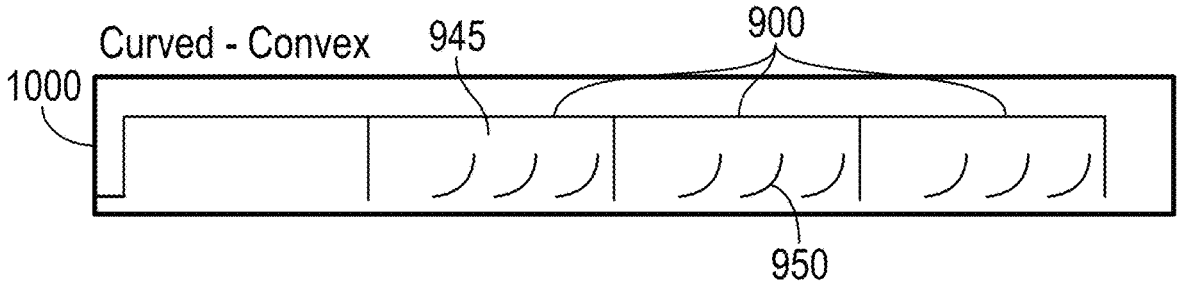

FIGS. 22A, 22B, and 22C depict suppressors 1000 having various embodiments of blade 950, with FIG. 22A showing a suppressor with blades 950 that are straight and with FIGS. 22B and 22C showing a suppressor with blades 950 that are curved convex and curved concave as shown.

Figure 22D:
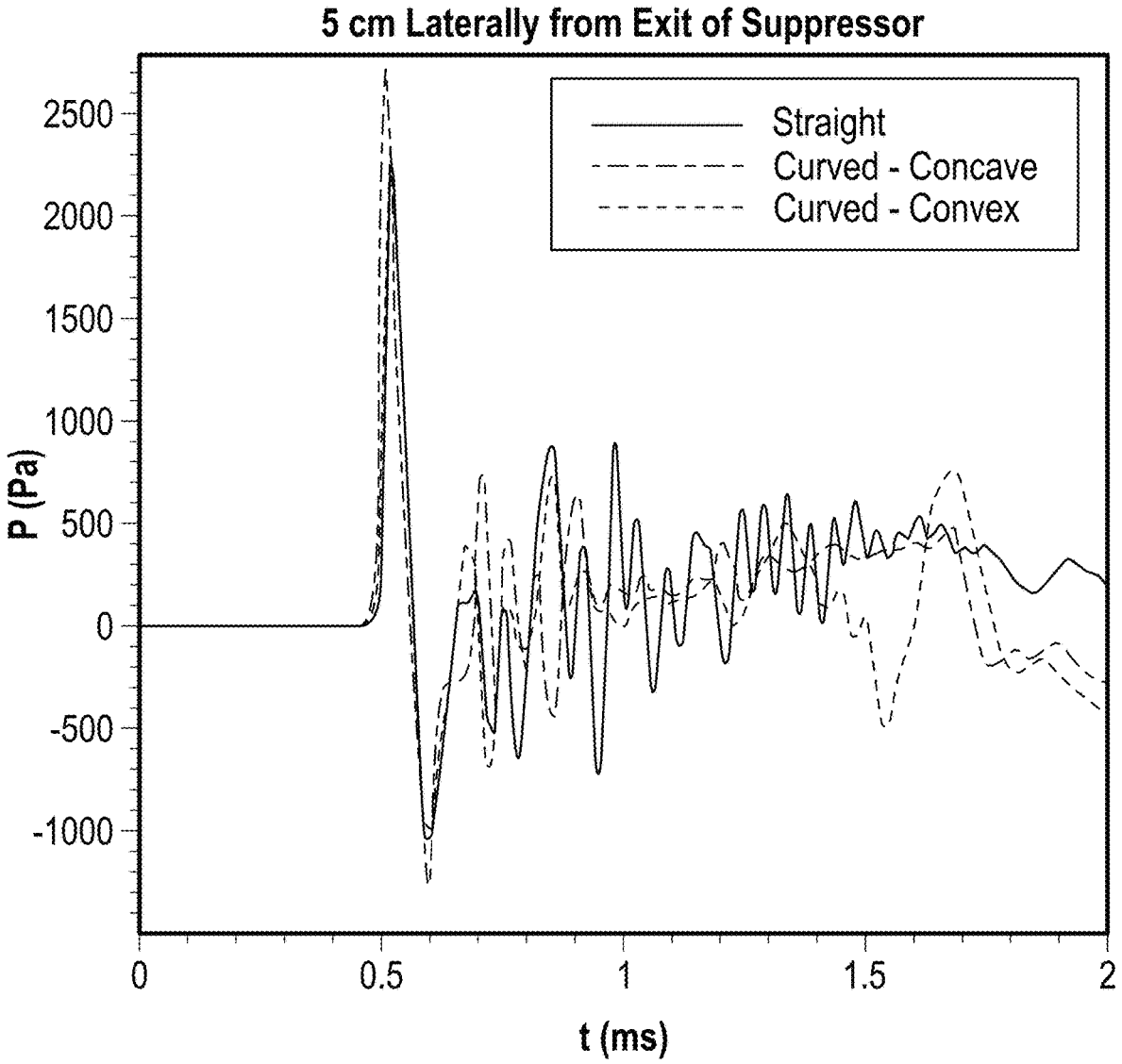
FIG. 22D depicts pressure as a function of time for the three-chamber suppressors shown in FIGS. 22A, 22B, and 22C.

FIG. 22D depicts simulation results showing performance of the embodiments of suppressors 1000 shown in FIGS. 22A, 22B, and 22C. As shown, the peak pressure is approximately the same, showing that the disclosed invention works with blades 950 having different shapes. However, these three embodiments show different frequency of oscillations in pressure. I speculate that the shape of blades 950 may be useful in controlling these oscillations and also the overall sound signature. Thus, I speculate that shape of blade 950 may be customized to make a suppressor 1000 suitable for particular use cases or environments. Because the bypass 945 for these three suppressor designs is the same size, I speculate that it is the bypass 945 size that helps produce the improved results.

The simulations presented herein are created using a proprietary computational fluid dynamics software system known as CAMBER that I developed. CAMBER is a modelling code that uses Cartesian Adaptive Meshing for Blast, Explosion and Release scenarios. It applies hydrocode and Computational Fluid Dynamic (CFD) techniques to simulate a variety of problems to include simulation of high-pressure blast events, explosions and gas-phase combustion. For the suppressor scenarios, the high-pressure, high-temperature gas produced by the firing of the round is modeled. CAMBER solves the equations that govern fluid-dynamics and predicts key phenomena such as pressure and rarefaction wave formation and movement. Key aspects such as the mixing of the gun propellant gas with ambient air is also represented. I speculate that my simulations run with my CAMBER software system are suitable for modeling the disclosed suppressor designs.

I speculate that the underlying principle to the improved performance is the control of the pressure reverberations inside the suppressor which in turn controls the reverberation of the external cone shock. Disclosed herein are exemplary embodiments that include straight and curved blades 950 as well as various sizes of bypass 945. The exemplary embodiments shown have been designed for use with a typical 5.56×45 mm supersonic NATO round. I speculate that different calibers and types of rounds will produce different chamber pressures, resulting in different internal pressures and wave dynamics inside the suppressor. Thus, I speculate that, while the overall design and components would be similar, the exact dimensions of the components and design elements such as spacing or otherwise may differ in order to achieve optimal performance for other caliber, types of rounds, and gun propellant.

PARTS LIST

| | |
|---|---|
| bullet 110 | second waveform secondary peak 830 |
| gun barrel 120 | blade chamber 900 |
| gun propellant gas 130 | entrance wall 910 |
| gun propellant gas shock 140 | entrance wall threading 911 |
| air 150 | entrance hole 915 |
| bullet bow shock 160 | exit wall 920 |
| cone shock 310 | exit wall threading 921 |
| compression waves 320 | exit hole 925 |
| slip line 340 | outer wall 930 |
| basic suppressor 400 | interior space 940 |
| first end cap 403 | bypass 945 |
| connector hole 404 | blade 950 |

-continued

PARTS LIST

| | |
|---|---|
| outer wall 405 | blade hole 951 |
| first chamber 410 | blade flare 952 |
| divider 415 | blade gap 953 |
| center hole 417 | blade narrow end 954 |
| second chamber 420 | blade wide end 955 |
| second end cap 425 | flat baffle chamber 956 |
| exit hole 427 | support member 960 |
| first area 710 | suppressor 1000 |
| second area 715 | brake chamber 1010 |
| third area 720 | muzzle brake 1020 |
| first waveform 801 | exit wall threading 1021 |
| second waveform 802 | brake threading 1022 |
| first waveform peak 810 | |
| second waveform initial peak 820 | |

The foregoing description of the embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof as permitted as a matter of law.

That which is claimed is:

1. A suppressor for reducing noise and muzzle flash generated by a firearm, comprising:

a. one or more blade chambers, wherein each of said one or more blade chambers comprises:

i. an entrance wall on a first side of each said blade chamber, an exit wall on a second side of each said blade chamber opposite said first side, and an outer wall connecting said entrance wall and said exit wall; further wherein said entrance wall comprises an entrance hole and said exit wall comprises an exit hole;

ii. an interior space defined by said entrance wall, said exit wall, and said outer wall for containing propellant gases from said firearm;

iii. a plurality of coaxial blades disposed within said interior space for redirecting said propellant gases, each of said plurality of coaxial blades comprising an approximate conical frustum with a center hole in a center of each said approximate conical frustum, and having a narrow end and a wide end, wherein said narrow end of each said approximate conical frustum faces said entrance hole and said wide end of each said approximate conical frustum faces said exit hole; and iv. one or more support members:

wherein each of said one or more blade chambers is configured to be removably attachable to one or more of said firearm, a muzzle brake, and another said blade chamber:

wherein said entrance hole, said exit hole, and each of said center holes are coaxial along a central axis and are capable of allowing a projectile fired from said firearm to pass through said entrance hole, each of said center holes, and said exit hole along said central axis;

wherein said plurality of coaxial blades are configured to form a gap between each said wide end of each of said plurality of coaxial blades and said narrow end of each one of said plurality of coaxial blades that is immediately adjacent to said each said wide end;

wherein each of said plurality of coaxial blades is affixed to at least one of said one or more support members and each of said one or more support members is affixed to an interior side of said outer wall of said blade chamber; and wherein placement of each of said plurality of coaxial blades forms a bypass for allowing gas flow between each said wide end of each of said plurality of coaxial blades and said outer wall of said interior space.

2. The suppressor of claim 1, wherein each of said plurality of coaxial blades have approximately the same dimensions.

3. The suppressor of claim 1, wherein each of said one or more support members is coplanar with said central axis.

4. The suppressor of claim 1, wherein each said bypass is between approximately 8 percent and approximately 63 percent of a cross-sectional area of said interior space that is perpendicular to said central axis.

5. The suppressor of claim 4 wherein each said bypass is between approximately 13 percent and 50 percent.

6. The suppressor of claim 4, wherein each said bypass is between approximately 28 percent and 35 percent.

7. The suppressor of claim 1, further comprising at least two blade chambers.

8. The suppressor of claim 7, further comprising at least one suppressor chamber that is not one of said one or more blade chambers.

9. The suppressor of claim 1, further comprising at least three blade chambers.

10. The suppressor of claim 1, wherein said approximate conical frustum is curved.

11. The suppressor of claim 1, wherein each of said plurality of coaxial blades have approximately the same dimensions and wherein each said bypass is between approximately 8 percent and approximately 63 percent of a cross-sectional area of said interior space that is perpendicular to said central axis.

12. The suppressor of claim 10, wherein each of said plurality of coaxial blades have approximately the same dimensions and wherein each said bypass is between approximately 8 percent and approximately 63 percent of a cross-sectional area of said interior space that is perpendicular to said central axis.

13. The suppressor of claim 1, wherein each said bypass is between approximately 10 percent and approximately 63 percent of a cross-sectional area of said interior space that is perpendicular to said central axis.

14. The suppressor of claim 13, wherein each of said plurality of coaxial blades have approximately the same dimensions.

15. The suppressor of claim 1, wherein each said bypass is between approximately 12 percent and approximately 63 percent of a cross-sectional area of said interior space that is perpendicular to said central axis.

16. The suppressor of claim 15, wherein each of said plurality of coaxial blades have approximately the same dimensions.

17. The suppressor of claim 1, wherein each said bypass is between approximately 14 percent and approximately 63 percent of a cross-sectional area of said interior space that is perpendicular to said central axis.

18. The suppressor of claim 17, wherein each of said plurality of coaxial blades have approximately the same dimensions.

19. The suppressor of claim 1, wherein each said bypass is between approximately 16 percent and approximately 63 percent of a cross-sectional area of said interior space that is perpendicular to said central axis.

20. The suppressor of claim 19, wherein each of said plurality of coaxial blades have approximately the same dimensions.

21. The suppressor of claim 1, wherein each said bypass is between approximately 18 percent and approximately 63 percent of a cross-sectional area of said interior space that is perpendicular to said central axis.

* * * * *